US009447953B2

(12) United States Patent
Lawlor

(10) Patent No.: US 9,447,953 B2
(45) Date of Patent: Sep. 20, 2016

(54) ADJUSTABLE LUMINAIRE

(71) Applicant: Generation Brands LLC, Skokie, IL (US)

(72) Inventor: Michael Lawlor, Chicago, IL (US)

(73) Assignee: GENERATION BRANDS LLC, Skokie, IL (US)

( * ) Notice: Subject to any disclaimer, the term of this patent is extended or adjusted under 35 U.S.C. 154(b) by 29 days.

(21) Appl. No.: 14/291,433

(22) Filed: May 30, 2014

(65) Prior Publication Data

US 2015/0345761 A1 Dec. 3, 2015

(51) Int. Cl.

| | |
|---|---|
| ***F21V 15/01*** | (2006.01) |
| ***F21V 19/00*** | (2006.01) |
| ***F21V 21/04*** | (2006.01) |
| ***F21V 21/14*** | (2006.01) |
| *F21V 29/70* | (2015.01) |
| *F21S 8/02* | (2006.01) |
| *F21V 19/04* | (2006.01) |
| *F21Y 101/02* | (2006.01) |

(52) U.S. Cl.

CPC ..... *F21V 21/14* (2013.01); *F21S 8/024* (2013.01); *F21S 8/026* (2013.01); *F21V 19/001* (2013.01); *F21V 19/04* (2013.01); *F21V 29/70* (2015.01); *F21Y 2101/02* (2013.01)

(58) Field of Classification Search

CPC ..... F21V 21/22; F21V 21/14; F21V 21/04; F21V 21/02

See application file for complete search history.

(56) References Cited

U.S. PATENT DOCUMENTS

| | | | | |
|---|---|---|---|---|
| 1,739,641 A | | 12/1929 | Lessmann | |
| 2,554,258 A | * | 5/1951 | Lundquist | F21V 21/30 362/364 |
| 2,800,575 A | | 7/1957 | Robertson et al. | |
| 2,859,333 A | | 11/1958 | Burliuk et al. | |
| 5,377,087 A | * | 12/1994 | Yoon | F21V 21/30 362/148 |
| 6,390,653 B1 | | 5/2002 | Schrewe | |
| 6,779,908 B1 | | 8/2004 | Ng | |
| 6,997,583 B2 | | 2/2006 | Broelemann | |

(Continued)

FOREIGN PATENT DOCUMENTS

| | | |
|---|---|---|
| DE | 19914108205 | 3/1991 |
| JP | 52-042680 | 4/1977 |
| JP | 52042680 A * | 4/1977 |

OTHER PUBLICATIONS

JP52042680A (English Translation).*
Machine Translation of Abstract for JP 52-042680 (Jun. 2, 2014) through Lexis Nexis Total Patent.

(Continued)

*Primary Examiner* — Renee Chavez
*Assistant Examiner* — Eric T Eide
(74) *Attorney, Agent, or Firm* — Marshall, Gerstein & Borun LLP; Randall G. Rueth

(57) ABSTRACT

Disclosed is a light fixture that includes a main body element that approximates a hollow spherical segment, a lamp assembly that includes a light source, an inner element, an outer element, wherein the light source, the inner element and the outer element are coupled together with the main body element positioned between the outer element and the inner element, and a central portion that extends through the main body element and couples the inner element to the outer element, wherein the lamp assembly is selectively movable relative to the main body element to alter a relative position and an angular orientation of the light source relative to the bottom opening without any portion of the lamp assembly extending blow the main body element.

20 Claims, 33 Drawing Sheets

(56) References Cited

U.S. PATENT DOCUMENTS

| | | | | |
|---|---|---|---|---|
| 7,744,259 | B2 | 6/2010 | Walczak et al. | |
| 8,038,327 | B1 * | 10/2011 | Franck | F21V 3/049 362/249.02 |
| 8,550,669 | B2 | 10/2013 | Macwan et al. | |
| 2003/0161153 | A1 | 8/2003 | Patti | |
| 2013/0170232 | A1 * | 7/2013 | Park | F21S 8/026 362/364 |
| 2013/0322084 | A1 * | 12/2013 | Ebisawa | F21V 21/04 362/269 |
| 2014/0003061 | A1 | 1/2014 | Chen et al. | |

OTHER PUBLICATIONS

Machine Translation of DE4108205 (Jun. 2, 2014) through Lexis Nexis Total Patent.

* cited by examiner

ADJUSTABLE LUMINAIRE

BACKGROUND

There is a need for attractive adjustable recessed lighting in residential and commercial environments. Other common needs for residential and commercial lighting includes energy efficiency, size and cost.

Light Emitting Diodes (LEDs) are one current type of an energy efficient light source. LEDs are thermally sensitive by nature, and some high-output LEDs require a heat sink for extended operation. Many heat sink designs are large and can limit how closely the LEDs can be placed next to each other. If the fixture is adjustable (amiable), the individual lights may require extra spacing so that the heat sinks do not interfere or collide with each other.

In many applications it is desirable for recessed lighting to have a pleasing appearance which can be defined by minimal visibility and a clean, "quiet" look from below the ceiling or wall in which it is installed. For this reason, a trim can be used to cover part of the luminaire, creating clean "frame" around an aperture where the light shines through. In some cases, adjusting the direction a light in a luminaire points may result in a significant portion of the emitted light shining on the trim, rather than passing through the aperture, resulting in reduced luminous flux from the luminaire.

DESCRIPTION OF THE ILLUSTRATED EMBODIMENTS

Figure 1:
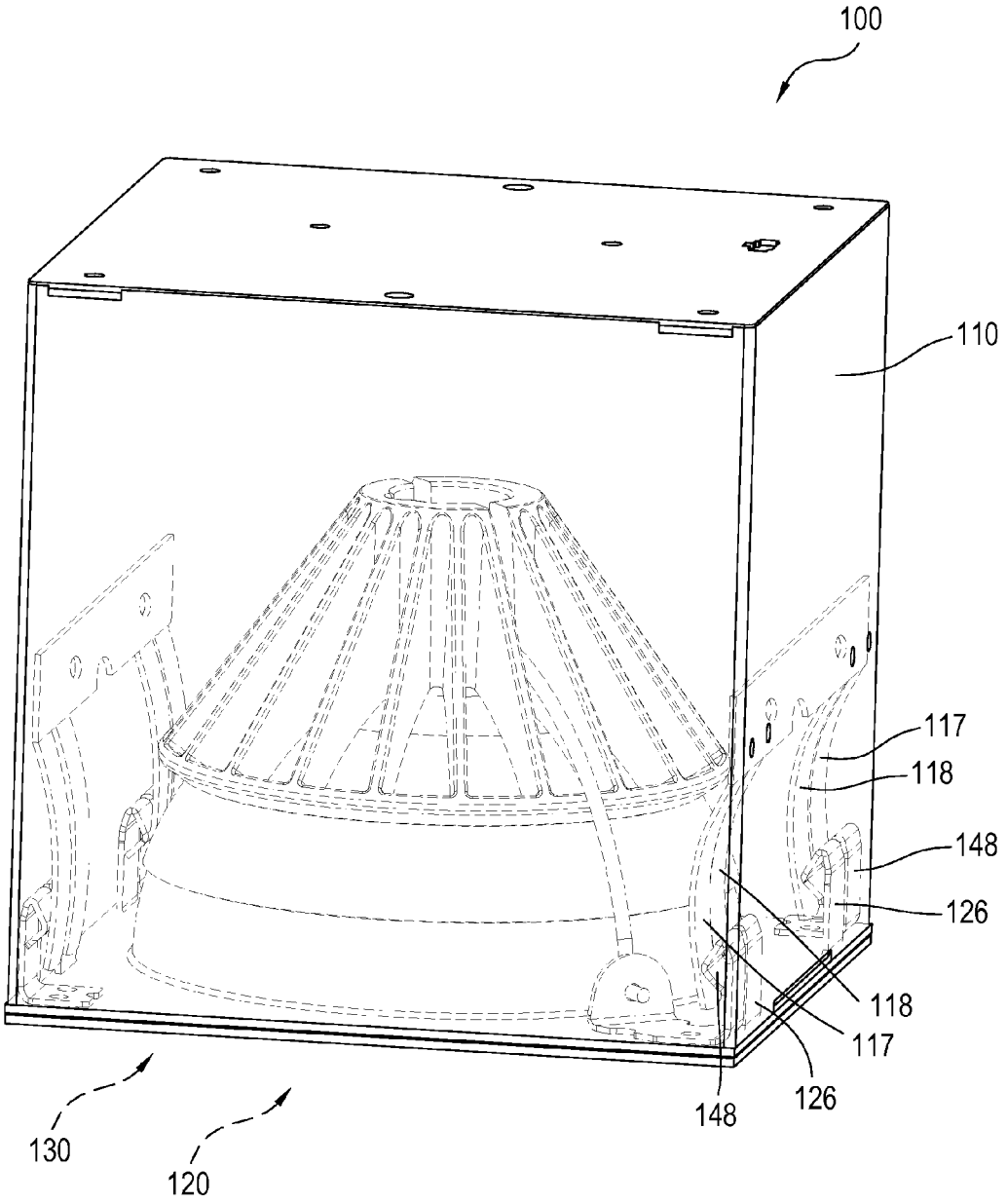
FIG. 1 is a perspective view of a light fixture.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated herein are contemplated as would normally occur to one skilled in the art to which the invention relates.

One aspect of the adjustable luminaries disclosed in this application provide a heat sink geometry which fits within a minimal footprint while providing high adjustability in the luminaire, allowing the individual light outputs to be spaced closely next to each other.

Another aspect of the adjustable luminaries disclosed in this application provide an adjustable light that remains centered such that the amount of emitted light blocked by trim placed over the luminaire is not significantly altered by adjusting the angle that the light shines through the trim.

In the claims and the description of the figures presented in this application, relative positioning terms such as "top" "up," "down," "bottom," "above," "below" and "under" are used to describe the relative position of components and the orientation of elements. These terms are not intended to be limiting relative to a gravitational orientation. The adjustable luminaries disclosed herein are frequently used as ceiling light fixtures. The description and drawings are presented on this basis. However, the disclosed adjustable luminaries are useful in other installations, such as in a wall or floor (shining upwardly). Similarly, the disclosed adjustable luminaries could be used with a curved surface, such that the luminaire installation could be oriented at any possible angle relative to the earth's surface, such as in a spherical structure. Relative positioning terms should be understood only in reference to the relative position shown in the drawings and the position of various components relative to each other, not to a gravitational orientation. Similarly, relative positioning terms should not be interpreted as limiting the orientation of the disclosed and claimed adjustable luminaire when installed.

All figures included in this application are drawn to scale.

Figure 2:
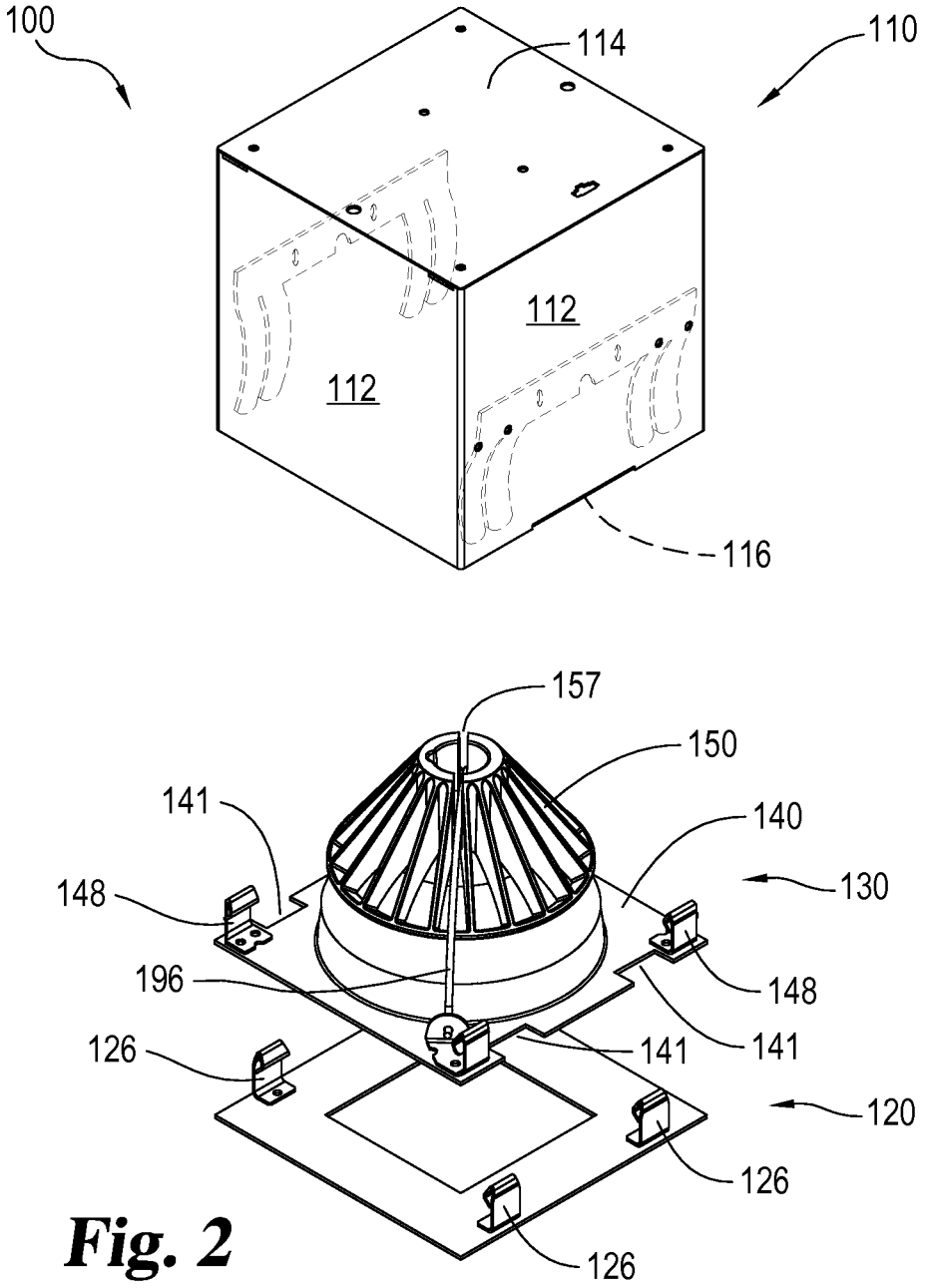
FIG. 2 is a top perspective exploded view of the FIG. 1 light fixture including an enclosure, an adjustable assembly and a trim piece.
Figure 3:
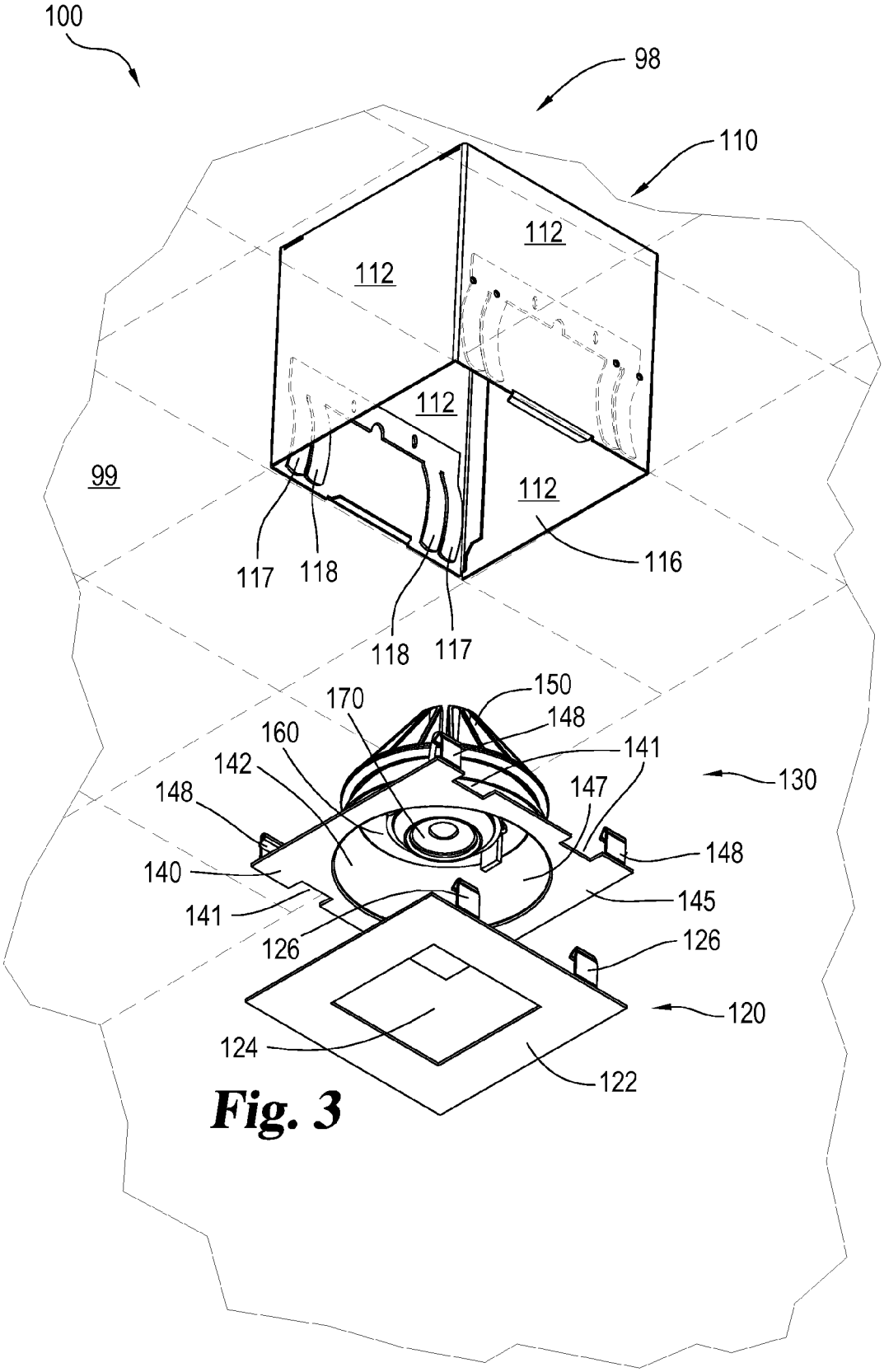
FIG. 3 is the bottom perspective exploded view of the FIG. 1 light fixture.
Figure 4:
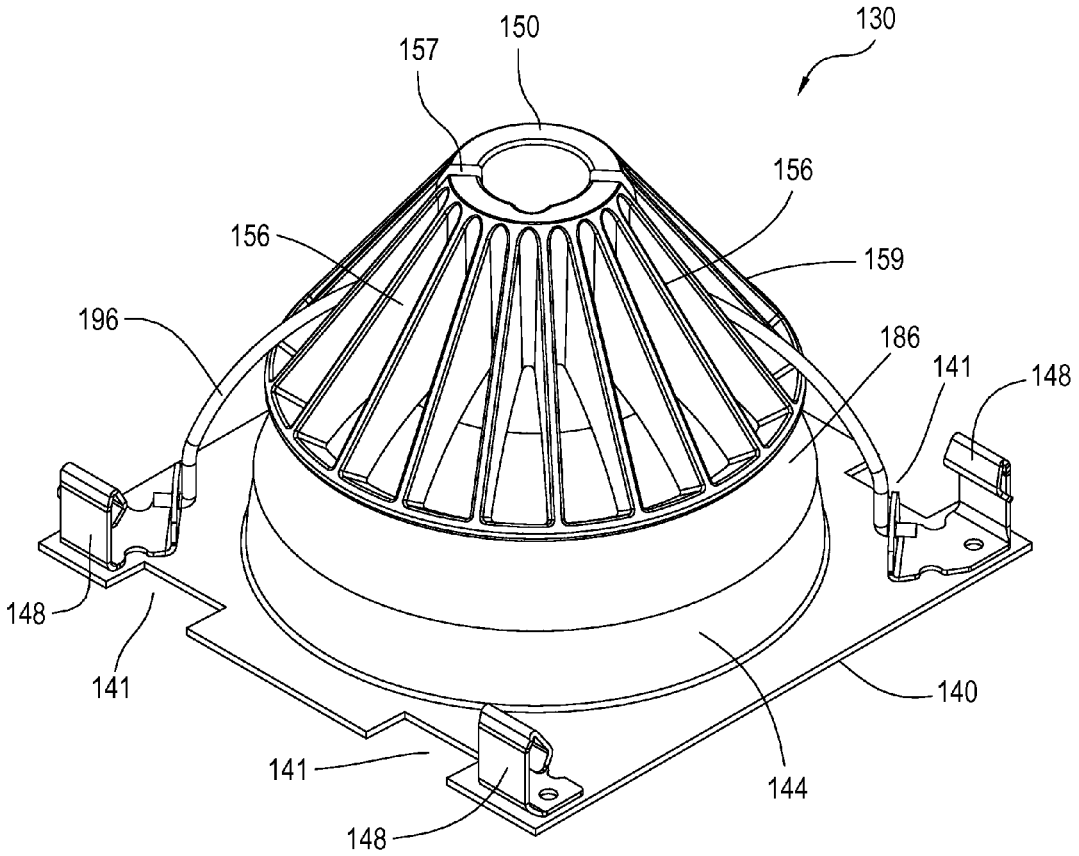
FIG. 4 is a top perspective view of the adjustable assembly portion of the FIG. 1 light fixture.
Figure 5:
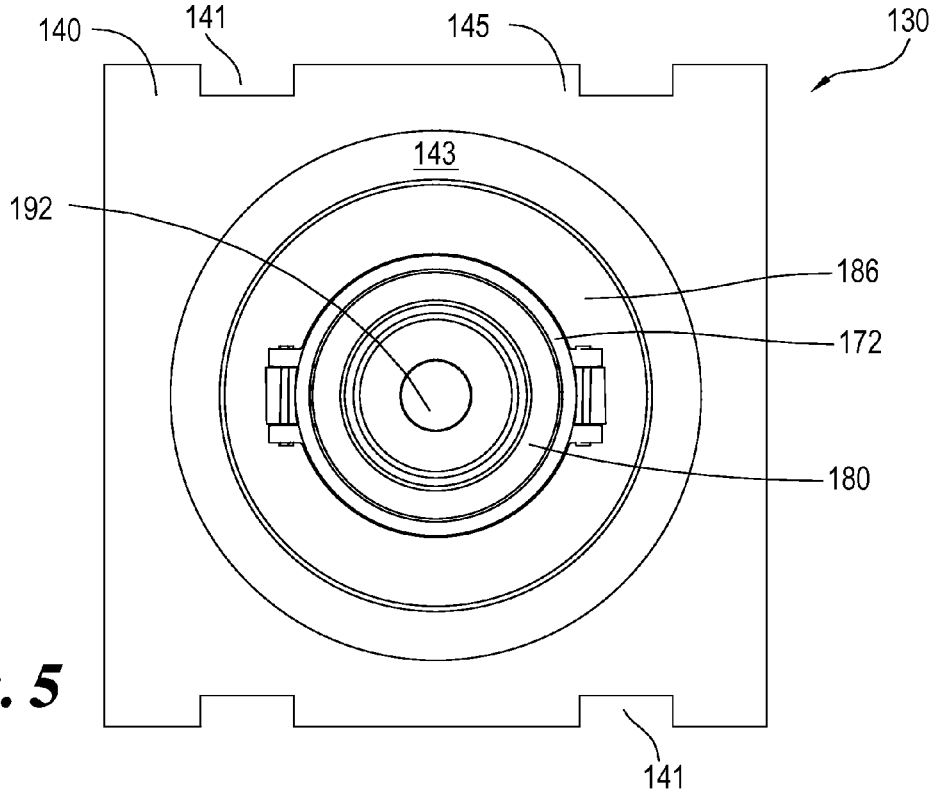
FIG. 5 is a bottom plan view of the FIG. 4 adjustable assembly.
Figure 6:
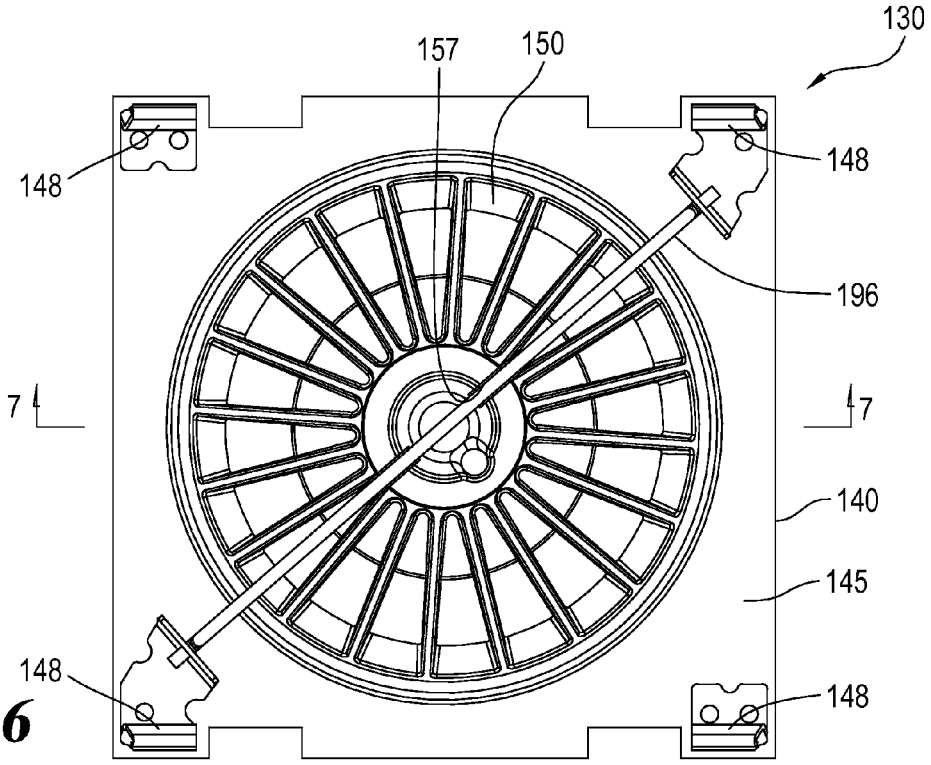
FIG. 6 is a top plan view of the FIG. 4 adjustable assembly.

Referring to FIGS. 1-3, light fixture 100 is illustrated including enclosure 110, trim 120 and adjustable assembly 130. Enclosure 110 and trim 120 are only disclosed in reference to light fixture 100 while alternative embodiments of adjustable assembly 130 are presented below. The disclosed alternative embodiments of adjustable assembly 130 are constructed and arranged to interface with enclosure 110 and trim 120 as described below for adjustable assembly 130.

Enclosure 110 includes a top 114 and four walls 112 defining opening 116 at the bottom of enclosure 110. Latches 117 and 118 are mounted on the interior of walls 112 in enclosure 110. Enclosure 110 may be constructed and arranged to facilitate mounting to an external structure such as ceiling or wall studs, or a dropped ceiling. Enclosure 110 may be constructed and arranged to be fully recessed into a ceiling or wall structure such that trim 120, when mounted to enclosure 110, is substantially flush with a surface of the wall or ceiling in which light fixture 100 is mounted. This is illustrated in FIG. 3 that shows enclosure 110 mounted inside ceiling 98 with the bottom opening substantially flush with ceiling surface 99.

Trim 120 includes plate 122 defining opening 124 and a plurality of catches 126 extending upwardly around the periphery of plate 122. In the illustrated embodiment, opening 124 is generally square shaped. However it should be understood that any desired shape may be utilized including, but not limited to, a circular shape or any desired type of polygon.

Adjustable assembly 130 generally includes main body 140, outer member 150, inner member 160, light assembly 170 and rod 196. Adjustable assembly 130 is described below in detail in the description of FIGS. 4-18.

Main body 140 of adjustable assembly 130 includes a plurality of catches 148 that project upward from flange 145. Flange 145 also defines a plurality of holes 141. Light fixture 100 is assembled by inserting adjustable assembly 130 through opening 116 in enclosure 110 with latches 117 engaging catches 148 thereby releasably securing adjustable assembly 130 to enclosure 110. Trim 120 is attached by passing catches 126 through holes 141 in flange 145 on main body 140 and engaging latches 118 on catches 126 thereby releasably securing trim 120 to enclosure 110.

Referring to FIGS. 4-8, adjustable assembly 130 is shown in isolated detail. Adjustable assembly 130 generally includes main body 140, outer member 150, inner member 160, light assembly 170 and rod 196.

Figure 9:
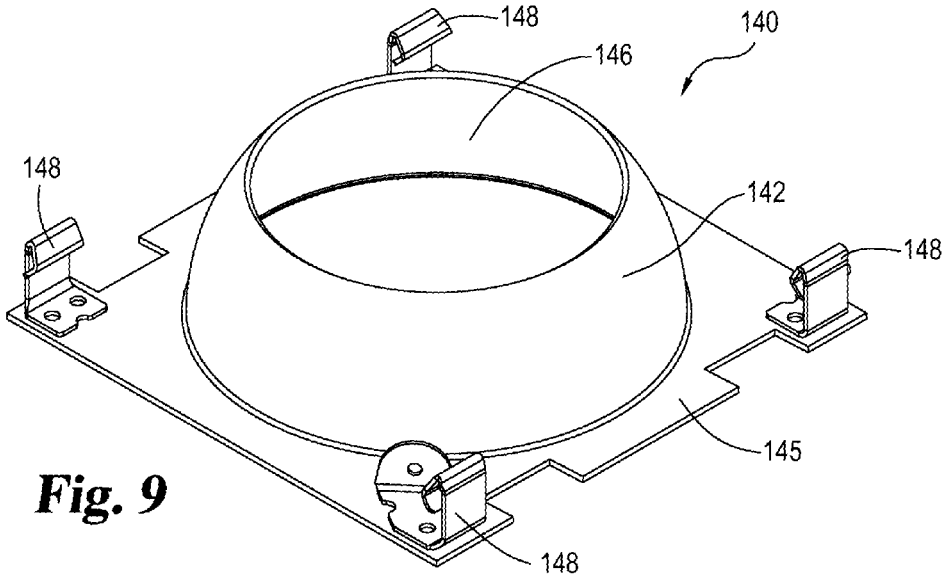
FIG. 9 is a top perspective view of a main body, an element of the FIG. 4 adjustable assembly.
Figure 10:
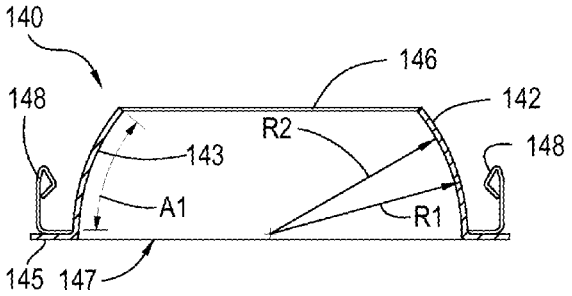
FIG. 10 is a side elevational cross-sectional view of the FIG. 9 main body.

As best seen in FIGS. 9-10, main body 140 includes flange 145, curved portion 142, with curved portion 142 defining inner surface 143 and outer surface 144, and curved portion 142 also defining top opening 146 and bottom opening 147. As described above, a plurality of catches 148 protrude upwardly from flange 145 with a plurality of holes 141 constructed to permit the passing of catches 126 on trim 120. Outer surface 144 may have radius R1 and inner surface 143 may have radius R2. Main body 140 defines bottom plane P1 that substantially lies along the bottom surface of flange 145. Curved portion 142 of main body 140 may define center point C that corresponds to the center of curved portion 142. In the illustrated embodiment, center point C is positioned above bottom plane P1 by approximately the thickness of flange 145.

Figure 18:
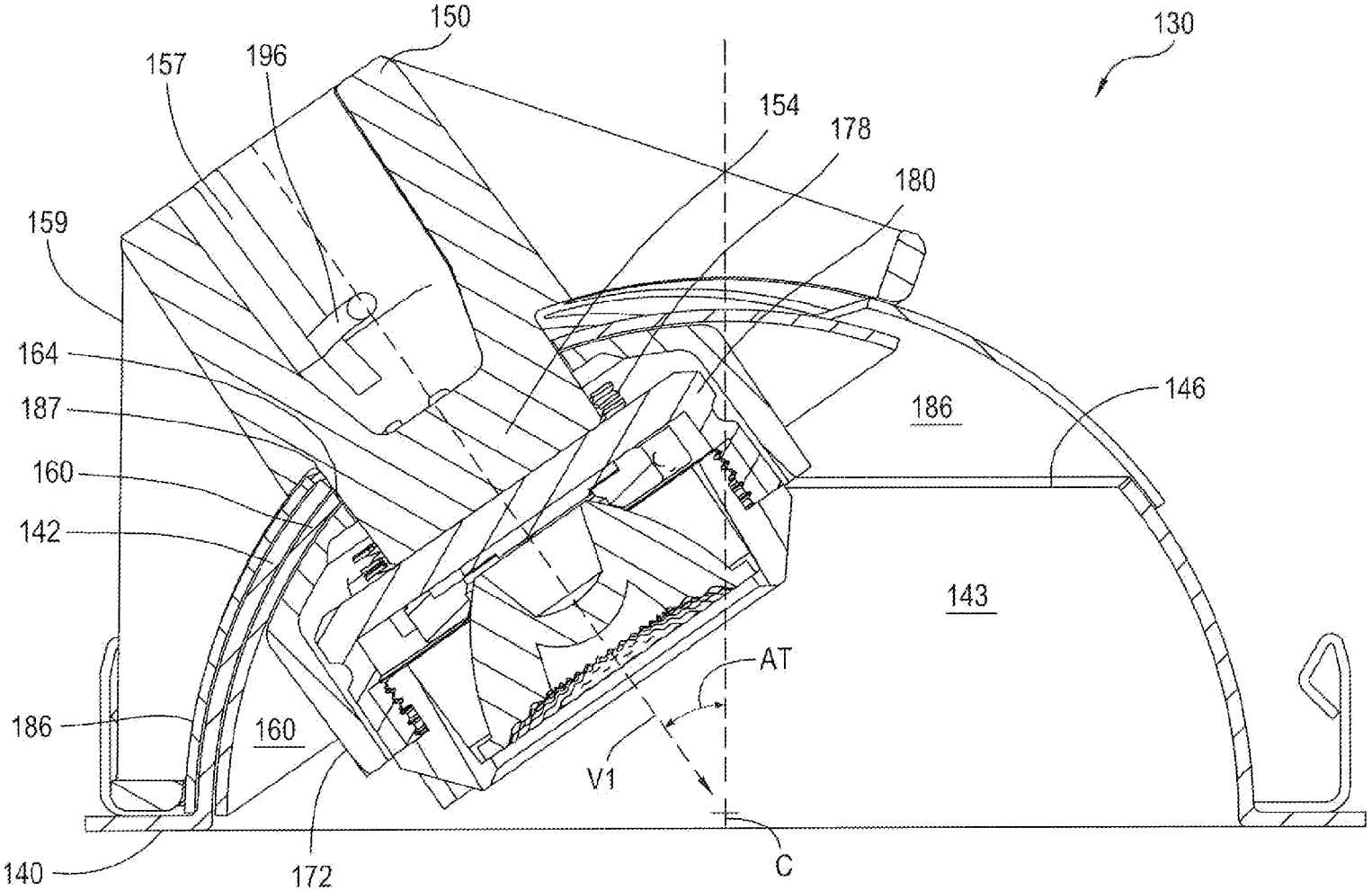
FIG. 18 is a side elevational cross-sectional view of the FIG. 14 configuration taken along line 18-18 on FIG. 17.
Figure 19:
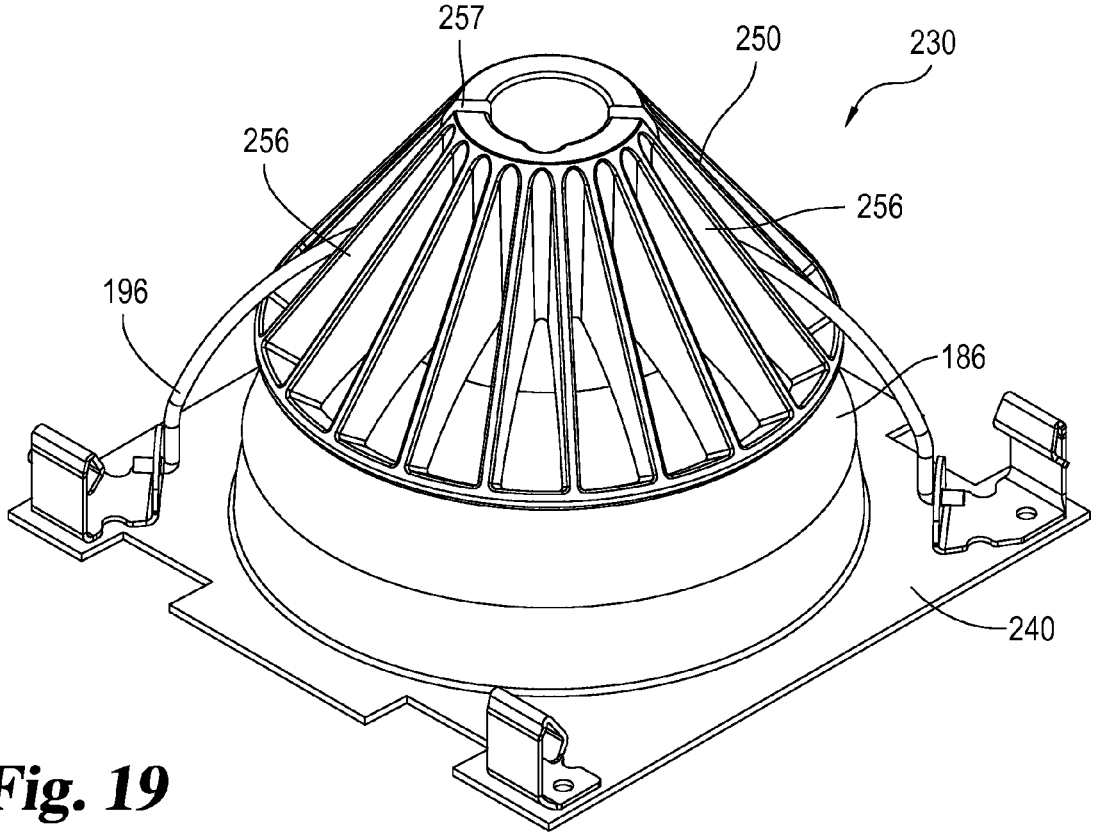
FIG. 19 is a top perspective view of a second embodiment of an adjustable assembly.
Figure 20:
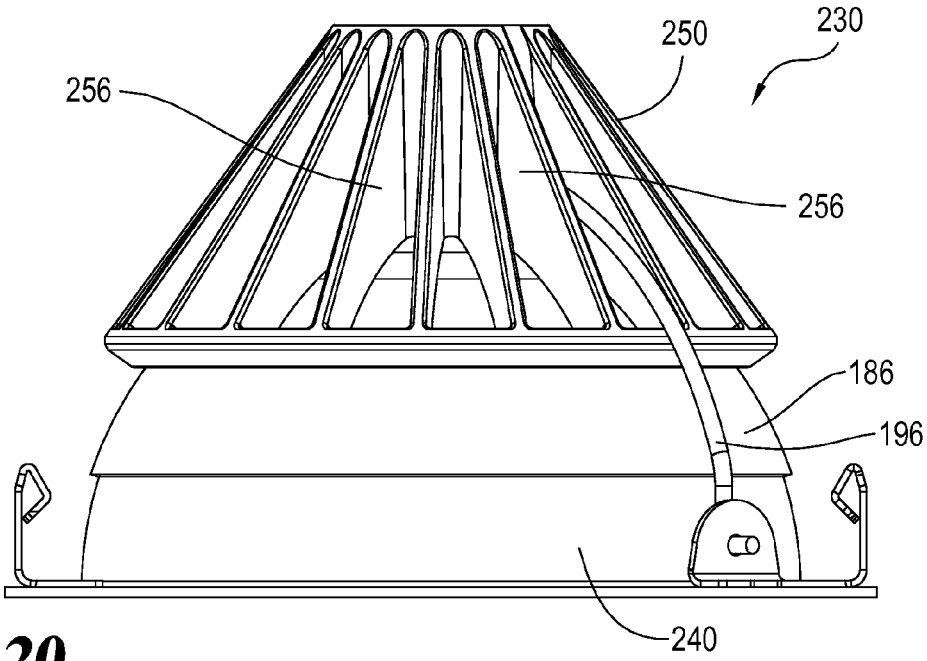
FIG. 20 is a side elevational view of the FIG. 19 adjustable assembly.
Figure 21:
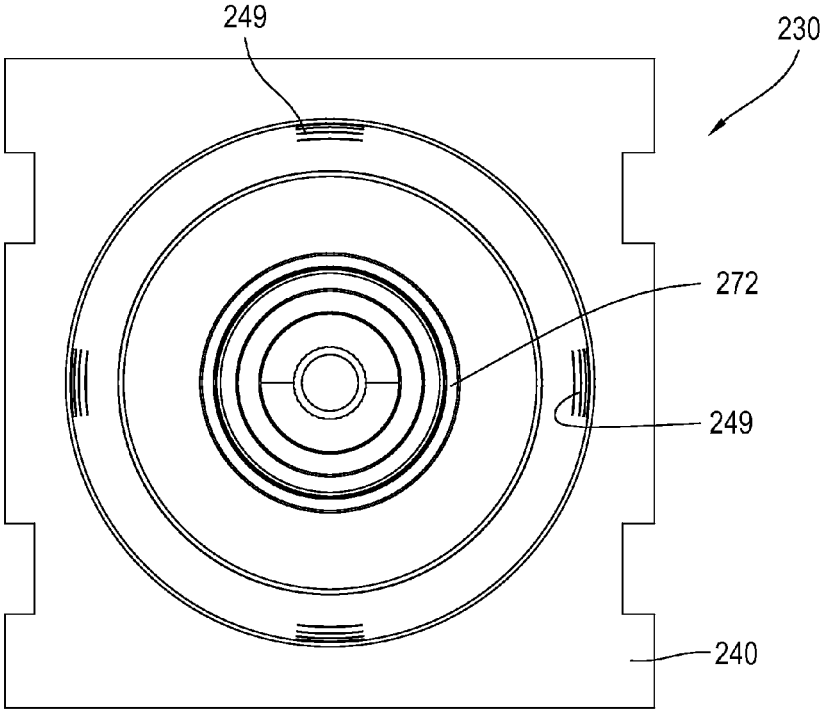
FIG. 21 is a bottom plan view of the FIG. 19 adjustable assembly.
Figure 22:
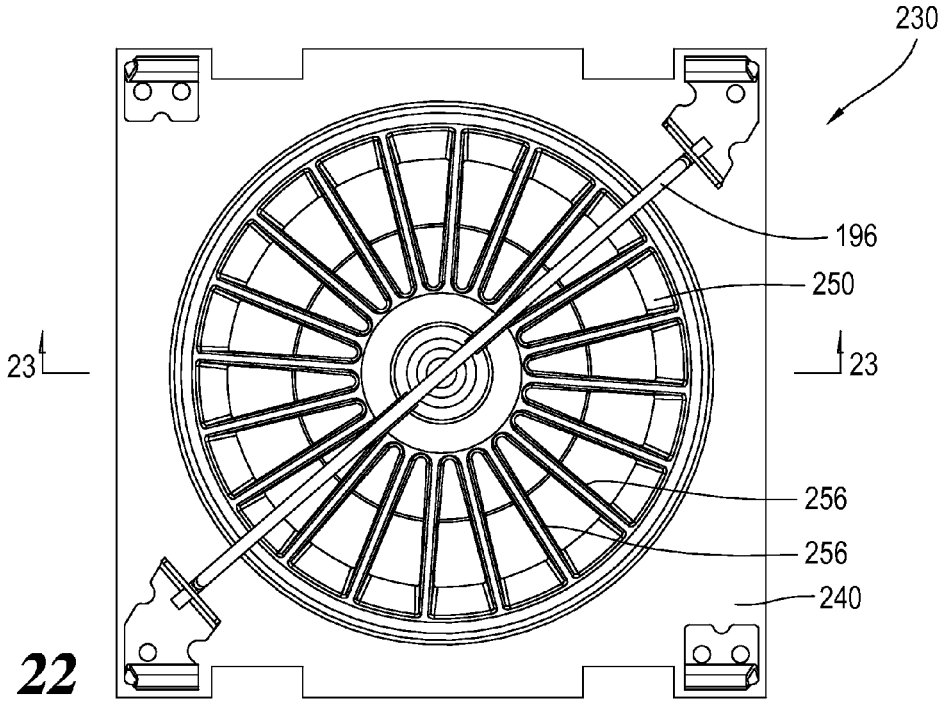
FIG. 22 is a top plan view of the FIG. 19 adjustable assembly.

Also as shown in FIG. 18, the direction of light emission V1 may pass through center point C regardless of the relative position of light source 190 relative to main body 140. In addition, no portion of light assembly 170, including light source 190 and lens 192, extends through bottom plane P1. Accordingly, light source 190 can be positioned anywhere allowed by the geometry of the various components of adjustable assembly 130 without interfering with or blocking use of trim 120 that may cover a portion of bottom opening 147 of main body 140. This may also create a more pleasing and consistent presentation of light fixture 100 when installed. In addition, while center point C is positioned above trim 120 by approximately the thickness of flange 145 and trim 120, this configuration may still result in emitted light being directed through an approximate middle of opening 124 in trim 120 and minimize emitted light being blocked by trim 120, regardless of the relative position of light source 190 to main body 140.

Curved portion 142 of main body 140 may approximate a hollow spherical segment and may have an arc angle A1. In the illustrated embodiment, arc angle AA is approximately 40 degrees. In alternative embodiments, arc angle AA may vary between approximately 35 degrees and approximately 45 degrees.

Flange 145 may extend away from curved portion 142 and bottom opening 147 from a hoop that approximates a great circle of the hollow spherical segment that may define curved portion 142. As such, curved portion 142 may be oriented substantially normally to flange 145 where curved portion 142 meets flange 145. In addition, together, curved portion 142, inner member 160 and intermediate member 186 may define a shape that approximates a hollow hemisphere.

Figure 8:
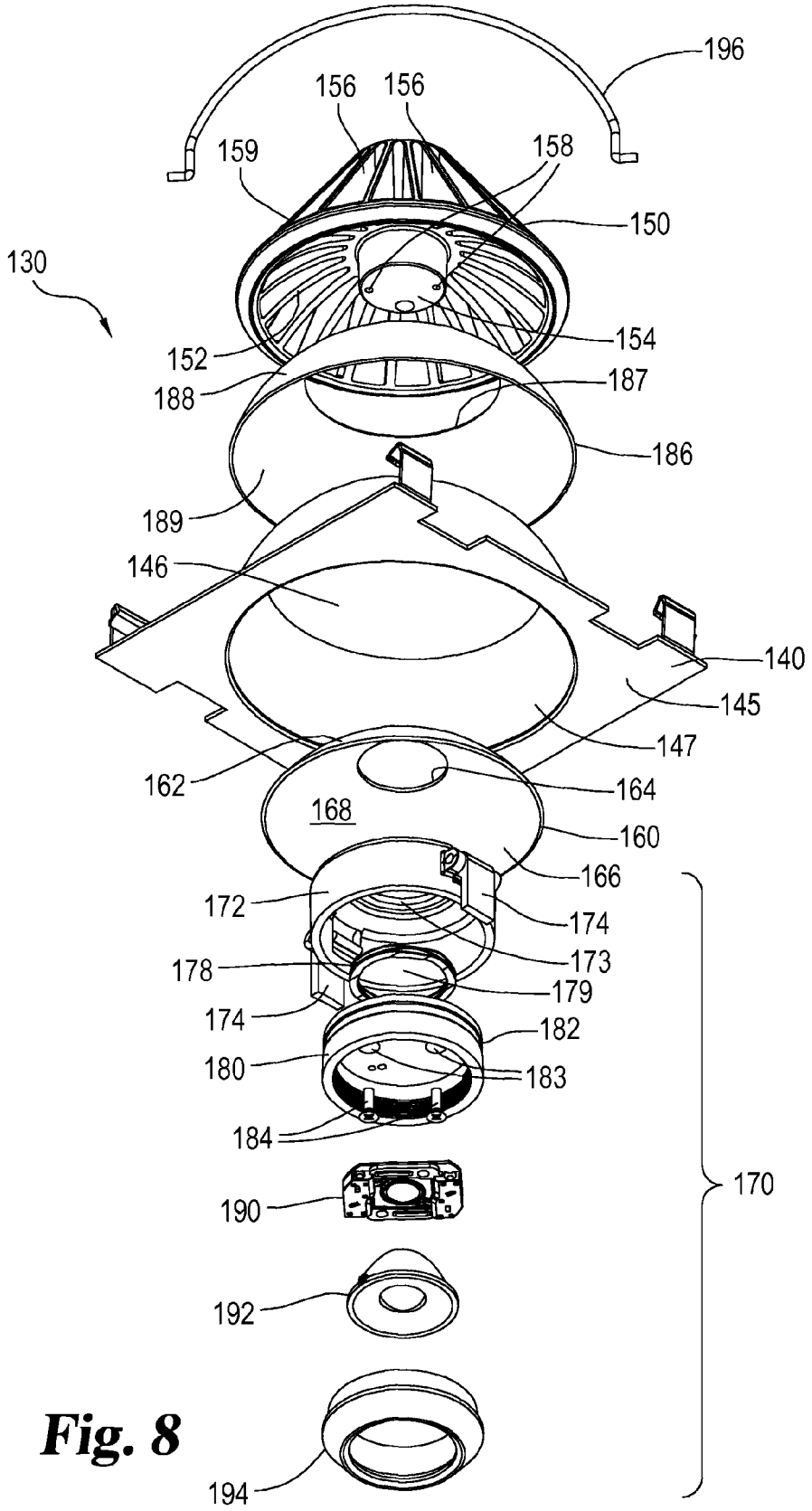
FIG. 8 is a bottom perspective exploded assembly view of the FIG. 4 adjustable assembly.
Figure 11:
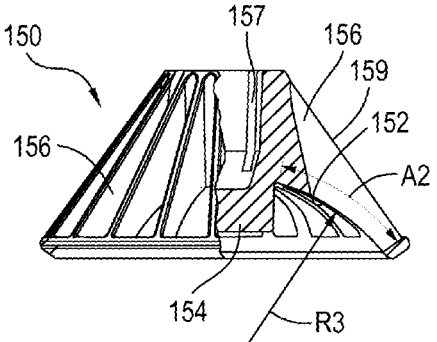
FIG. 11 is a side elevational view of an outer member, an element of the FIG. 4 adjustable assembly, including a partial cross-sectional view.

As best seen in FIGS. 8 and 11, outer member 150 defines a curved surface 152 having radius R3 with center portion 154 extending downwardly from the center of curved surface 152. Outer member 150 includes a plurality of fins 156 on its top with fins 156 extending upwardly and outwardly from curved surface 152. Note that, in the illustrated embodiment, curved surface 152 is defined by fins 156 that are spaced apart from each other, such that curved surface 152 is not contiguous, but instead encompasses a plurality of fin segments that together define curved surface 152.

Outer member 150 also defines slot 157 that is constructed and arranged to interact with rod 196 as described below. Outer member 150 also includes holes 158 that may be used for coupling outer member 150 to light assembly 170 as described below. Fins 156 define a conical profile 159 on the outer surface of outer member 150. Curved surface 152 may approximate a segment of a hollow sphere and may define arc angle A2 that extends away from center portion 154 to the outer edge of curved surface 152.

Figure 12:
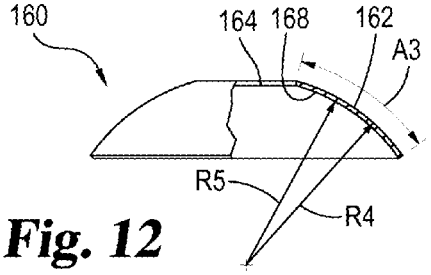
FIG. 12 is a side elevational view of an inner member, an element of the FIG. 4 adjustable assembly, including a partial cross-sectional view.

As best illustrated in FIGS. 8 and 12, inner member 160 is a curved planar member with outer surface 162 defining top opening 164 and inner surface 168 defining bottom opening 166. Outer surface 162 has a radius R4 and inner surface 168 has a radius R5. Inner member 160 approximates a hollow spherical segment and has an arc angle A3.

Figure 13:
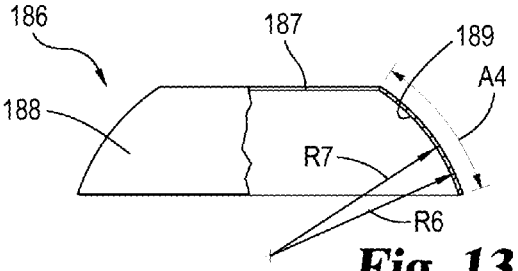
FIG. 13 is a side elevational view of an intermediate member, an element of the FIG. 4 adjustable assembly, including a partial cross-sectional view.
Figure 14:
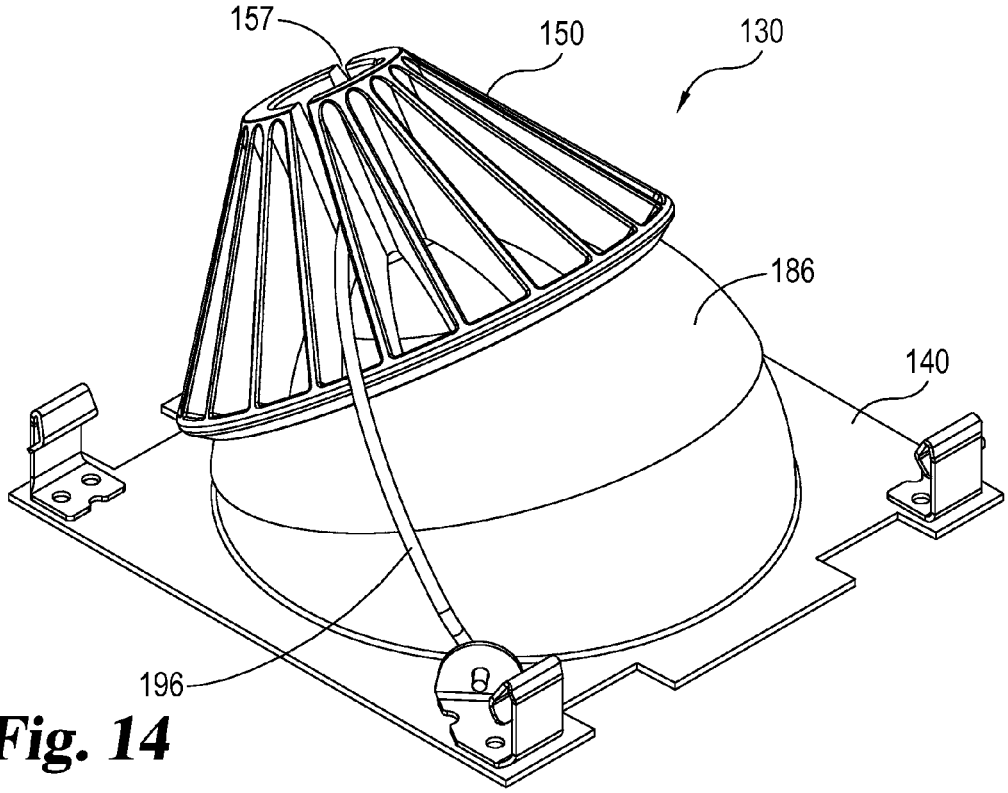
FIG. 14 is a top perspective view of the FIG. 4 adjustable assembly with the outer member skewed at an angle relative to the main body.
Figure 15:
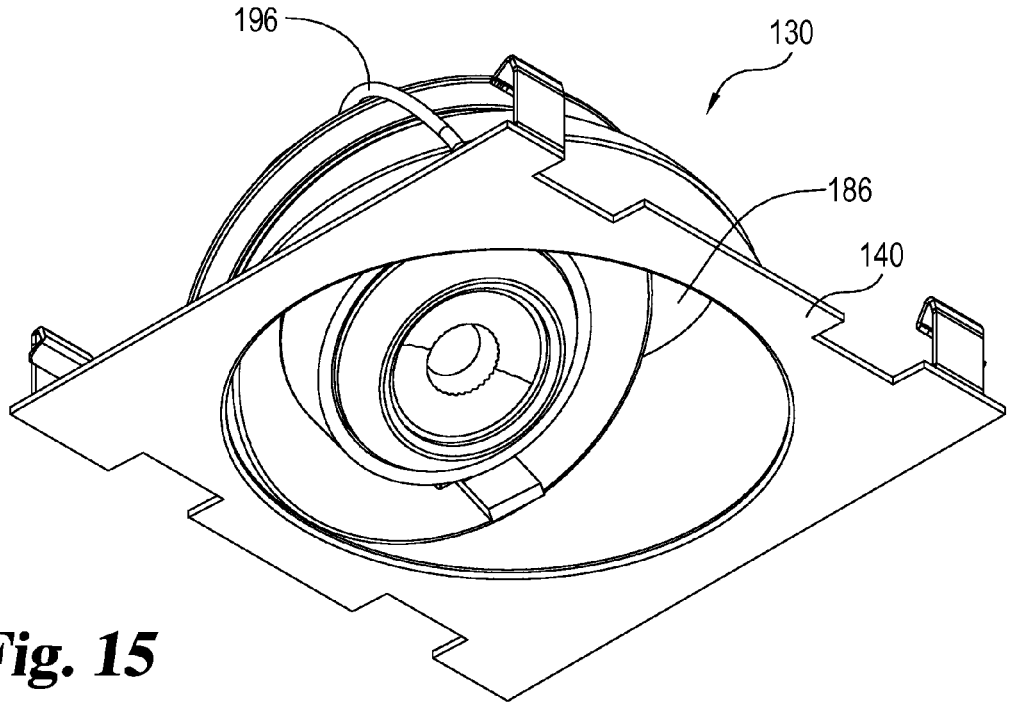
FIG. 15 is a bottom perspective view of the FIG. 14 configuration.
Figure 16:
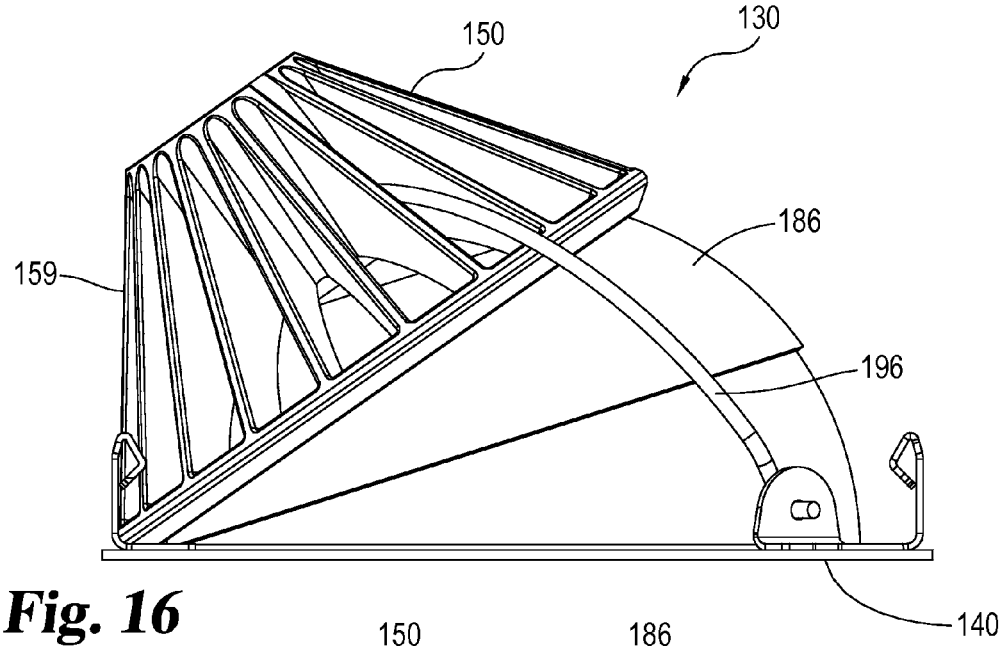
FIG. 16 is a side elevational view of the FIG. 14 configuration.
Figure 17:
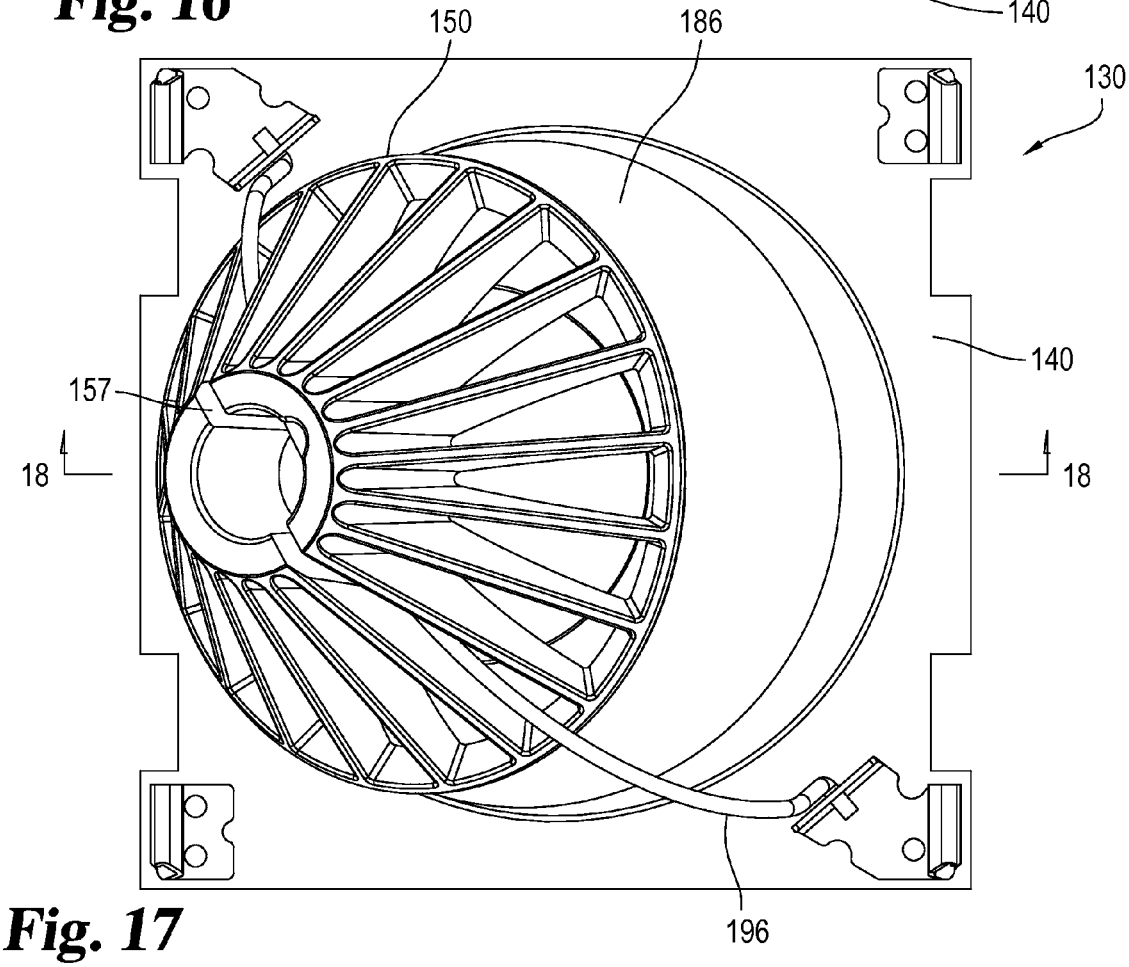
FIG. 17 is a top plan view of the FIG. 14 configuration.

Referring now to FIG. 13, intermediate member 186 is illustrated. Intermediate member 186 is a curved planar member with outer surface 188, inner surface 189 and defines top opening 187. Outer surface 188 has a radius R6 and inner surface 189 has a radius R7. Intermediate member 186 may approximate a hollow spherical segment and may have an arc angle A4.

As best shown in FIG. 8, light assembly 170 includes locking collar 172, spring 178, retaining cap 180, light source 190, lens 192 and retaining ring 194. Locking collar 172 is a generally cylindrical body that defines opening 173 and includes levers 174. Each lever 174 includes pivot point 175, extension 176 and projection 177. Retaining cap 180 has a generally cylindrical outer surface that includes groove 182 and holes 183.

Adjustable assembly 130 is assembled with outer member 150 and retaining cap 180 coupled together with bolts 184 passing through holes 183 and secured in holes 158 on outer member 150 with intermediate member 186, main body 140 and inner member 160, locking collar 172 and spring 178 entrapped between outer member 150 and retaining cap 180. Center portion 154 passes through top opening 178, top opening 146, top opening 164, opening 173 and opening 179. Light source 190 is mounted on retaining cap 180 with lens 192 positioned over light source 190 and secured in place by retaining ring 194. Light source 190 is operatively coupled to outer member 150 through center portion 154 and the connection to retaining cap 180. Inner member 160 is operatively coupled to outer member 150 as inner member 160 is forced to move angularly with outer member 150 because center portion 154 substantially fills top opening 164.

Rod 196 is pivotally secured to brackets attached to flange 145 and passes through slot 157 on outer member 150. Rod 196 generally interacts with outer member 150 to prevent substantial rotation of outer member 150 relative to main body 140. Alternative embodiments may utilize other structures to perform the same rotation prevention function of rod 196, including, but not limited to, a cable, wire, chain, etc.

Locking collar 172 is movable relative to retaining cap 180 through actuation of levers 174. Projection 177 on lever 174 extends into groove 182 on retaining cap 180. Levers 174 are held in position relative to locking collar 172 by pins located at pivot points 175 that permit rotation of levers 174 relative to locking collar 172. Rotating extensions 176 away from the center of locking collar 172 in a radially outward direction moves projections 177 downward, thereby moving locking collar 172 upward relative to retaining cap 180. As retaining cap 180 is secured directly to outer element 150 through center portion 154, movement of locking collar 172 relative to retaining cap 180 moves locking collar 172 relative to outer element 150.

Spring 178 is positioned between locking collar 172 and retaining cap 180 with center portion 154 passing through opening 179. Spring 178 generally biases locking collar 172 upward and away from retaining cap 180. Operation of levers 174 by rotating extensions 176 toward locking collar 172, generally results in further compression of spring 178.

Inner member 160, main body 140 and intermediate member 186 are sandwiched between outer member 150 and locking collar 172. In the configuration illustrated in FIG. 7, this results in an abutting relationship between the members as illustrated that may result in sufficient friction between the contacting members to substantially prevent relevant movement absent an external force. In the illustrated configuration, internal surface 168 of inner member 160 abuts locking collar 172. Outer surface 162 of inner member 160 abuts inner surface 143 of main body 140. Outer surface 144 of main body 140 abuts inner surface 189 of intermediate member 186. Outer surface 188 of intermediate member 186 abuts curved portion 152 of outer member 150.

In the illustrated embodiment, light source 190 includes one or more light emitting diodes (LED) as are well known in the art. It should be understood that alternative light sources may be used including but not limited to incandescent lamps such as filament wires, halogen lamps, fluorescent lamps and gas discharge lamps. While not illustrated, electrical wiring for light source 190 may pass through retaining cap 180 and center portion 154 of outer member 150. As described above, rod 196 generally prevents rotation of outer member 150 relative to main body 140. This may advantageously reduce strain on wiring (not illustrated) for light source 190 by reducing twisting of light source 190 relative to wires passing through main body 140 that may be fixedly attached to an external power source for light source 190. This may reduce incidence of wires inadvertently becoming severed or disconnected.

Figure 7:
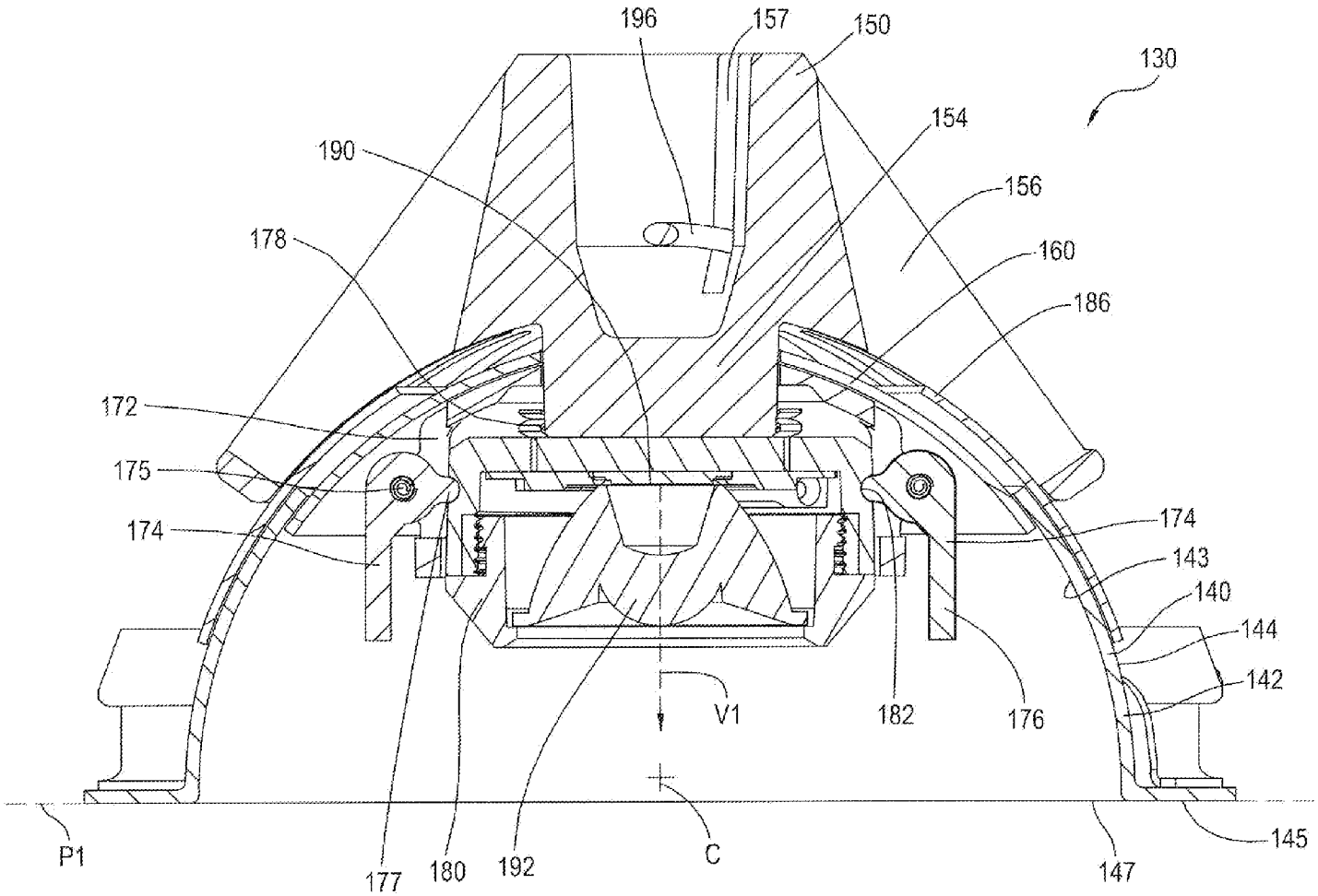
FIG. 7 is a side elevational cross-sectional view of the FIG. 4 adjustable assembly taken along line 7-7 in FIG. 6.

As best shown in FIG. 7, light source 190 in combination with lens 192 has a direction of light emission V1 that may correspond to a center of an arc of light emitted from lens 192. In the embodiment illustrated in FIG. 7, the direction of light emission V1 substantially passes through center point C.

As shown in FIGS. 14-18, the illustrated outer member 150 is selectively movable relative to main body 140 to alter the position of light source 190 relative to main body 140 and to alter the angular orientation of light source 190 relative to bottom plane P1. Relative movement of outer member 150 also moves the position and angular orientation of light source 190 and lens 192 relative to main body 140. In the illustrated embodiment, this may be facilitated by actuating levers 174 to move locking collar 172 relative to retaining cap 180 to relieve the force exerted by locking collar 172 on inner member 160 to reduce the force pressing outer member 150, main body 140, inner member 160 and intermediate member 186 together. This reduces fictional forces between outer member 150, main body 140, inner member 160 and intermediate member 186 and permits relative movement between inner member 160, main body 140, intermediate member 186 and outer member 150. Outer member 150 may be moved relative to main body 140 to any position allowed by the interaction of center portion 154 residing in the geometry of top opening 146. Abutment of center portion 154 against curved portion 142 defines the outer limit of movement permitted.

As shown in FIG. 18, arc angles A1, A2, A3 and A4 may all be substantially equal. This configuration maximizes the contact area between outer member 150, main body 140, inner member 160 and intermediate member 186 while also maximizing the tilt angle AT of light source 190 and lens 192 relative to the top center position illustrated in FIG. 7. In the illustrated embodiment, tilt angle AT is approximately 35 degrees (maximum). Note that in addition to rotating away from the top center position illustrated in FIG. 7, outer member 150 and light source 190 can also be rotated around a complete 360 degrees, as viewed from above, to permit the orientation of light source 190 and the lens 192 to be moved in two directions.

In alternative embodiments, the relative arc angles of each component do not have to be substantially equal. For example, main body 140 arc angle A1 may be between approximately 80 percent and approximately 120 percent of arc angle A3 of inner member 160.

Also as shown in FIG. 18, conical profile 159 of outer member 150, when positioned at a maximum tilt angle AT, may define a substantially vertical surface, as shown on the left side of FIG. 18. Conical profile 159 may permit the positioning of outer member 150 at any position relative to main body 140 allowed by the geometry of the illustrated components while fitting within enclosure 110. This geometry also lends itself to a narrow light fixture 100 that may permit multiple light fixtures 100 to be installed in close proximity with each other because extra width around the opening of light fixture 100 is not required to accommodate a wide heat sink structure.

Intermediate member 186 is optionally included to cover gaps or voids that may be present between outer member 150 and main body 140, particularly when tilt angle AT is near its maximum. Such gaps or voids might otherwise be visible through bottom opening 147. Inclusion of intermediate member 186 may provide a more consistent visible appearance for the inside of adjustable assembly 130 when viewed through bottom opening 147, regardless of the relative position of light source 190.

The relative position of outer member 150 relative to main body 140 may be subsequently re-secured by actuating levers 174 to reapply an abutting force between locking collar 172 and inner member 160, thereby sandwiching inner member 160, main body 140 and intermediate member 186 between outer member 150 and locking collar 172 and substantially securing the relative position of each member by friction between outer member 150, main body 140, inner member 160 and intermediate member 186.

Referring to FIGS. 19-24, a second embodiment of an adjustable assembly is shown in isolated detail as adjustable assembly 230. Adjustable assembly 230 generally includes main body 240, outer member 250, inner member 160, intermediate member 186, light assembly 270 and rod 196. Inner member 160, intermediate member 186 and rod 196 are substantially the same as the components described above with regard to adjustable assembly 130. Adjustable assembly 230 is interchangeable with adjustable assembly 130 for use in light fixture 100. The description of other elements of light fixture 100 are not repeated for brevity.

Main body 240 is substantially the same as main body 140 except that main body 240 includes markings 249. Markings 249 may optionally be included to provide a user visible feedback regarding an approximate tilt angle AT. While markings are only disclosed in some embodiments herein, it should be understood that markings can be optionally included in any of the disclosed adjustable assemblies. Main body 240 includes inner surface 243, outer surface 244 and flange 245.

Figure 23:
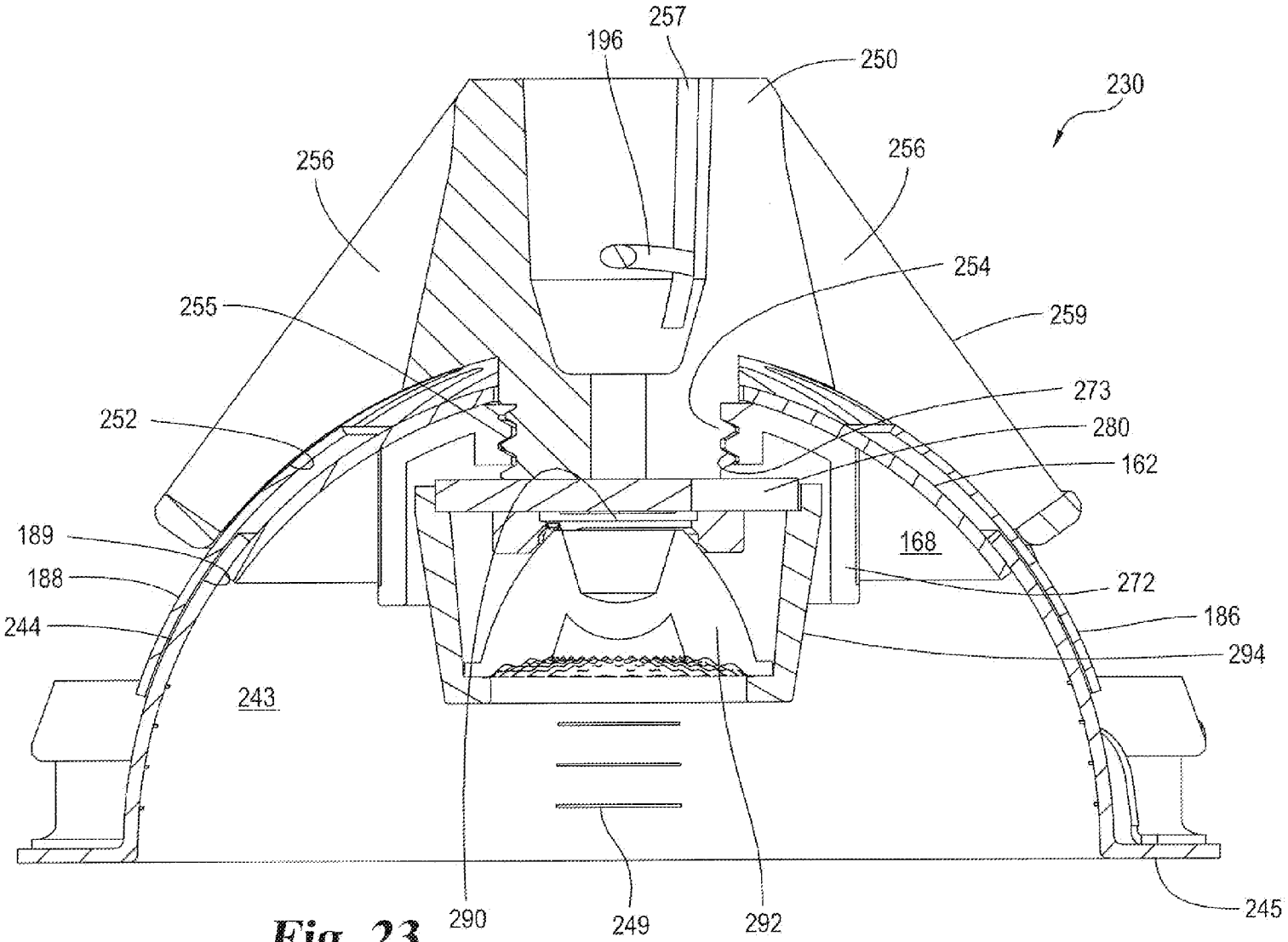
FIG. 23 is a side elevational cross-sectional view of the FIG. 19 adjustable assembly taken along line 23-23 in FIG. 22.
Figure 24:
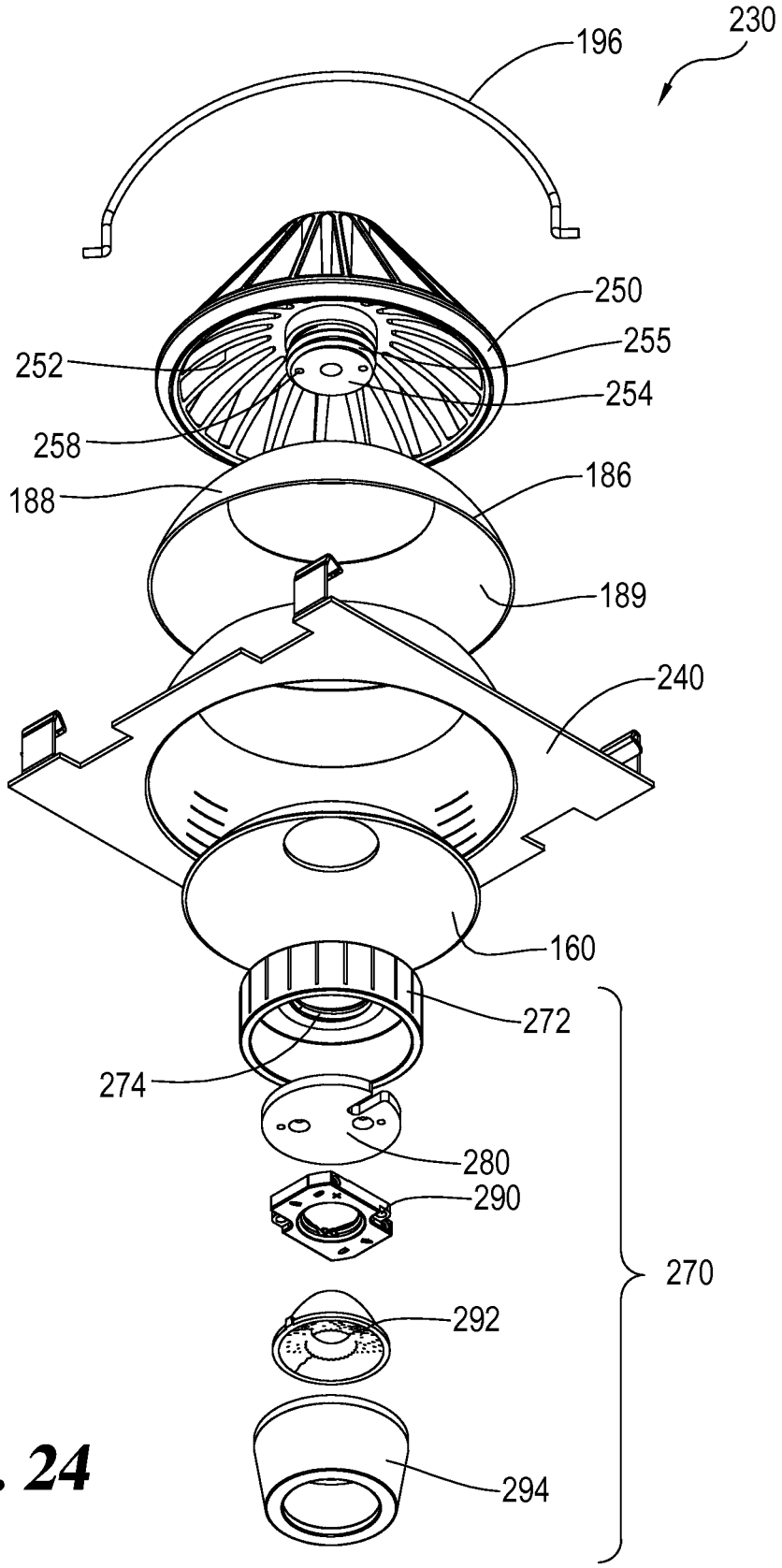
FIG. 24 is a bottom perspective exploded assembly view of the FIG. 19 adjustable assembly.
Figure 25:
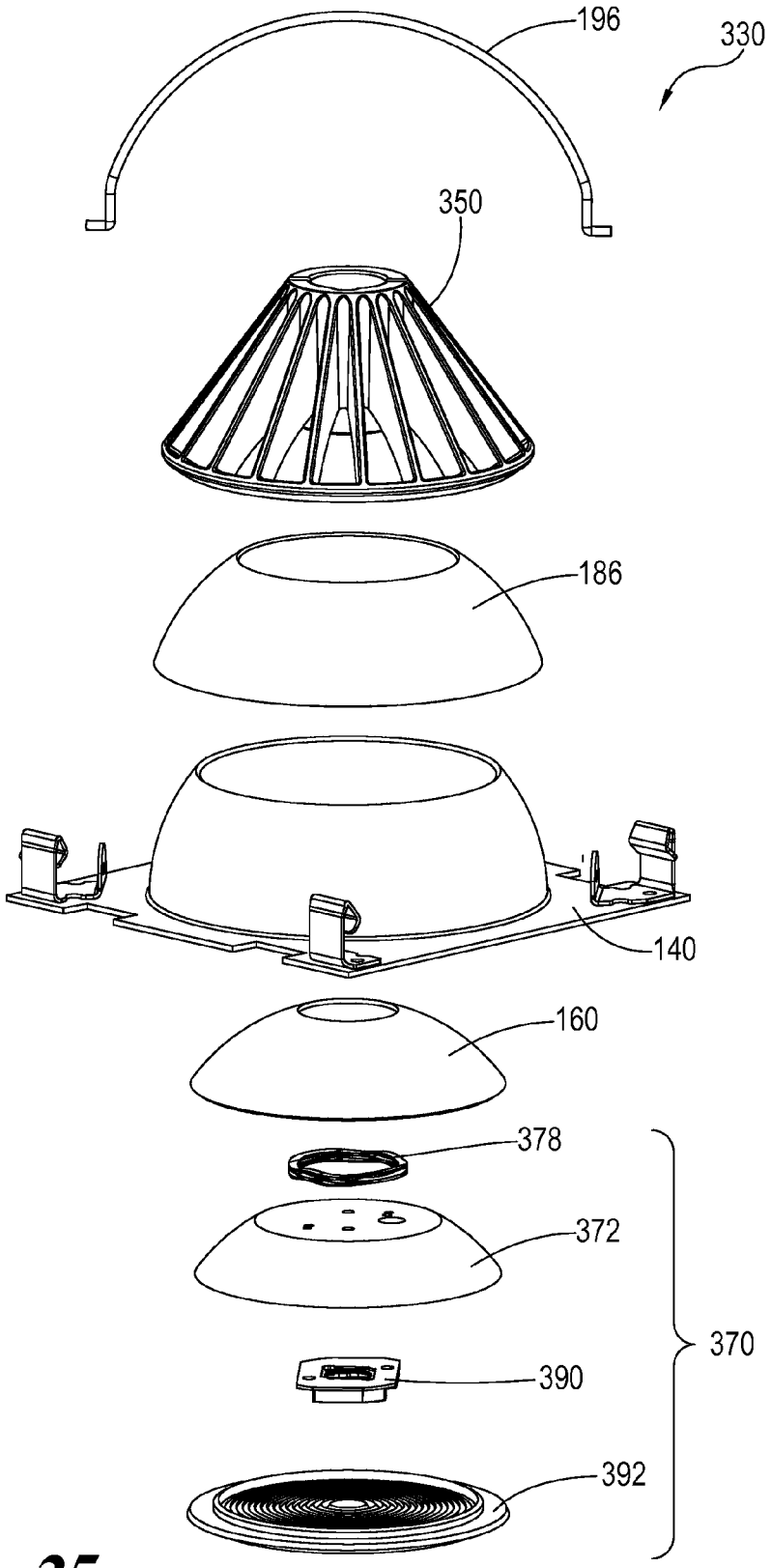
FIG. 25 is an exploded assembly view of a third embodiment of an adjustable assembly.
Figure 26:
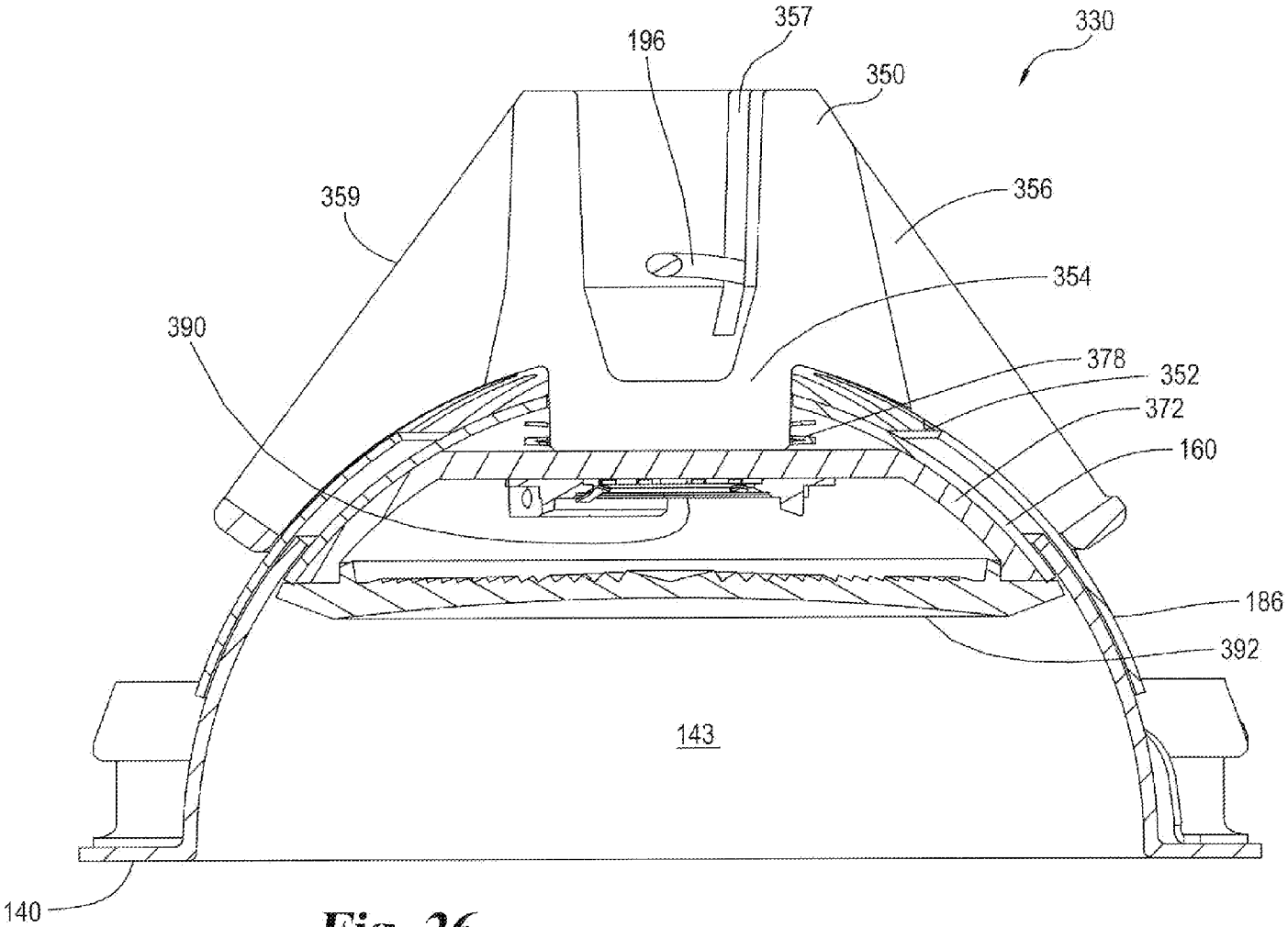
FIG. 26 is a side elevational cross-sectional view of the FIG. 25 adjustable assembly.
Figure 27:
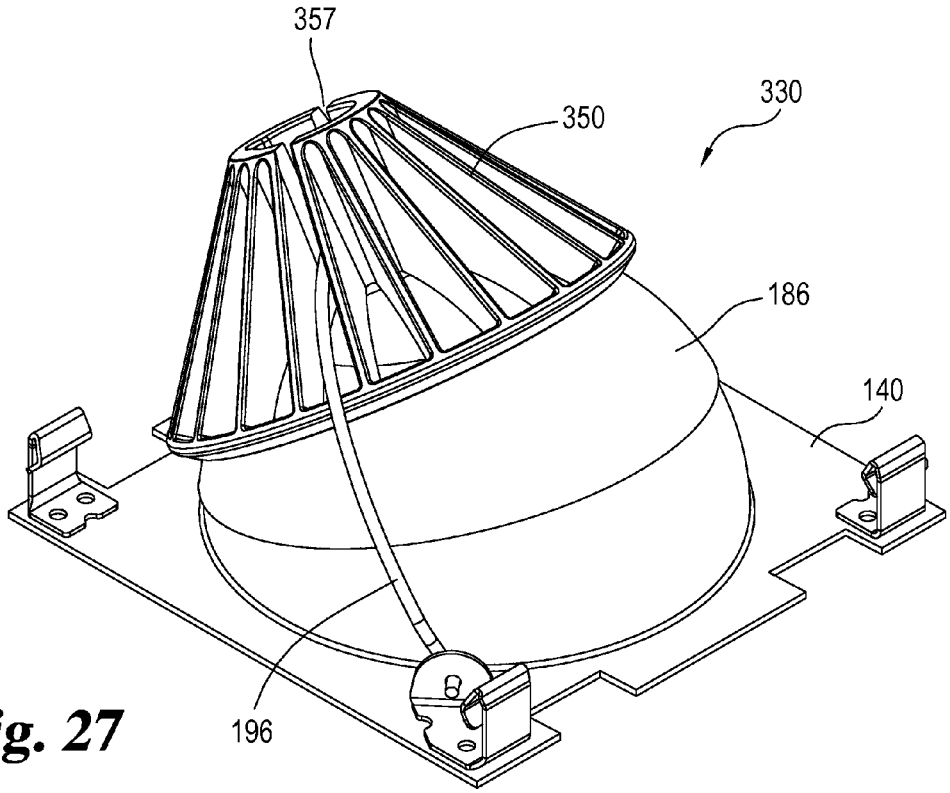
FIG. 27 is a top perspective view of the FIG. 25 adjustable assembly with the outer member skewed at an angle relative to the main body.
Figure 28:
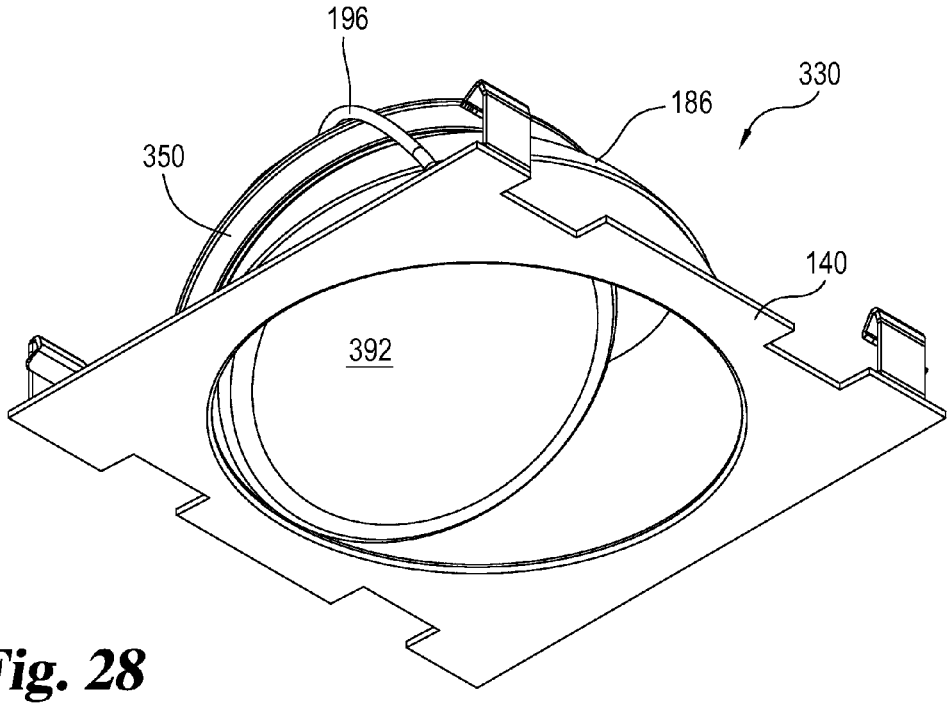
FIG. 28 is a bottom perspective view of the FIG. 27 adjustable assembly.

As best seen in FIGS. 23 and 24, outer member 250 defines a curved surface 252 with center portion 254 extending downwardly from the center of curved surface 252. Center portion 254 includes external threads 255. Outer member 250 includes a plurality of fins 256 on its top with fins 256 extending upwardly and outwardly from curved surface 252. Note that curved surface 252 is defined by fins 256 and fins 256 are spaced apart from each other, such that curved surface 252 is not contiguous, but instead encompasses a plurality of fin segments that together define curved surface 252.

Outer member 250 also defines slot 257 that is constructed and arranged to interact with rod 196 as described above to block substantial rotation of outer member 250 with respect to main body 140. Outer member 250 also includes holes 258 that may be used for coupling outer member 250 to light source 290 as described below. Fins 256 define a conical profile 259 on the outer surface of outer member 250. Curved surface 252 may approximate a segment of a hollow sphere.

As best shown in FIGS. 23 and 24, light assembly 270 includes locking collar 272, mounting plate 280, light source 290, lens 292 and retaining ring 294. Locking collar 272 is a generally cylindrical body that defines internally threaded opening 273 having internal threads 274.

Adjustable assembly 230 is assembled with outer member 250 and mounting plate 280 coupled together with bolts (not shown) with intermediate member 186, main body 140 and inner member 160, locking collar 272 entrapped between outer member 250 and mounting plate 280. Center portion 254 passes through intermediate member 186, main body 140 and inner member 160. Light source 290 is mounted on mounting plate 280 with lens 292 positioned over light source 290 and secured in place by retaining ring 294.

Rod 196 is pivotally secured to brackets attached to flange 145 and passes through slot 257 on outer member 250. Rod 196 generally interacts with outer member 250 to prevent substantial rotation of outer member 250 relative to main body 140.

Locking collar 272 is threadingly engaged with center portion 254 of outer member 250 and is movable relative to mounting plate 280 through threaded rotation of locking collar 272 relative to outer member 250. Rotating locking collar 272 in a tightening direction moves locking collar 272 upward relative to mounting plate 280. As mounting plate 280 is secured to outer element 250 through center portion 254, movement of locking collar 272 relative to mounting plate 280 also moves locking collar 272 relative to outer element 250.

Inner member 160, main body 140 and intermediate member 186 are sandwiched between outer member 250 and locking collar 272. In the configuration illustrated in FIG. 23, internal surface 168 of inner member 160 abuts locking collar 272. Outer surface 162 of inner member 160 abuts inner surface 143 of main body 140. Outer surface 144 of main body 140 abuts inner surface 189 of intermediate member 186. Outer surface 188 of intermediate member 186 abuts curved portion 252 of outer member 250. Sufficiently tightening locking collar 272 against inner member 160 may result in sufficient friction between the contacting members to substantially prevent relevant movement absent an external force. In addition, loosening locking collar 272 may permit relative movement between outer member 250, inner member 160, main body 140 and intermediate member 186 to allow the orientation of light source 290 and lens 292 to be repositioned relative to main body 140.

In the illustrated embodiment, light source 290 includes one or more light emitting diodes (LED) as are well known in the art. It should be understood that alternative light sources may be used including but not limited to incandescent lamps such as filament wires, halogen lamps, fluorescent lamps and gas discharge lamps. While not illustrated, electrical wiring for light source 290 may pass through mounting plate 280 and center portion 254 of outer member 250. As described above, rod 196 generally prevents rotation of outer member 250 relative to main body 140. This may advantageously reduce strain on wiring (not illustrated) for light source 290 by reducing twisting of light source 290 relative to wires passing through main body 140 that may be fixedly attached to an external power source for light source 290.

Referring now to FIGS. 25-29, a third embodiment of an adjustable assembly is shown in isolated detail as adjustable assembly 330. Adjustable assembly 330 generally includes main body 140, outer member 350, inner member 160, intermediate member 186, light assembly 370 and rod 196. Main body 140, inner member 160, intermediate member 186 and rod 196 are substantially the same as the components described above with regard to adjustable assembly 130. Adjustable assembly 330 is interchangeable with adjustable assembly 130 for use in light fixture 100. The description of other elements of light fixture 100 are not repeated for brevity.

Similar to outer members 150 and 250, outer member 350 defines a curved surface 352 with center portion 354 extending downwardly from the center of curved surface 352. Outer member 350 includes a plurality of fins 356 on its top with fins 356 extending upwardly and outwardly from curved surface 352. Note that curved surface 352 is defined by fins 356 and fins 356 are spaced apart from each other, such that curved surface 352 is not contiguous, but instead encompasses a plurality of fin segments that together define curved surface 352.

Outer member 350 also defines slot 357 that is constructed and arranged to interact with rod 196 as described above to block substantial rotation of outer member 350 with respect to main body 140. Fins 356 define a conical profile 359 on the outer surface of outer member 350. Curved surface 352 may approximate a segment of a hollow sphere.

Light assembly 370 includes locking light housing 372, spring 378 light source 390 and lens 392. Light housing 372 is coupled directly to center portion 354 of outer housing. Light source 390 and lens 392 are coupled to light housing 372 with lens 392 oriented to project light emitted from light source 390. Spring 378 is positioned around center portion 354 and abuts light housing 372 and inner member 160.

Adjustable assembly 330 is assembled with outer member 350 and light housing 372 coupled together with intermediate member 186, main body 140, spring 378 and inner member 160, entrapped between outer member 350 and light housing 372. Center portion 354 passes through intermediate member 186, main body 140 and inner member 160.

Inner member 160, main body 140 and intermediate member 186 are sandwiched between outer member 350 and light housing 372. Inner member 160 abuts light housing 372 and main body 140. Main body 140 also abuts intermediate member 186. Intermediate member 186 also abuts curved portion 352 of outer member 350. Spring 378 biases inner member 160, main body 140, intermediate member 186 and outer member 350 together to generate sufficient friction between the contacting members to substantially prevent movement of light source 390 relative to main body 140 absent an external force. However, these components may be configured such that the biasing force provided by spring 378 is not sufficient to prevent a human user from manually overcoming the friction between the components to manually reposition light source 390 relative to main body 140.

Figure 29:
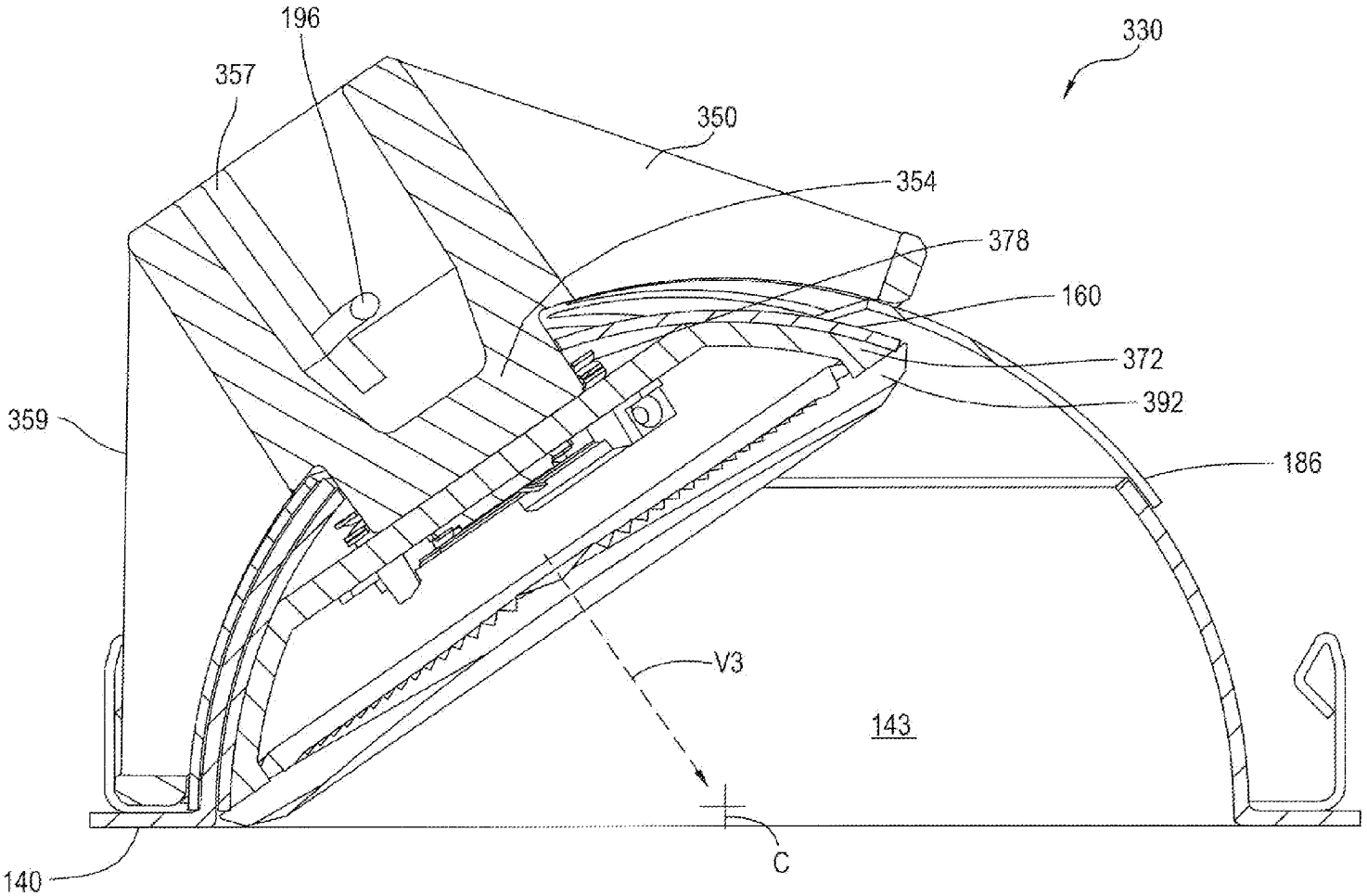
FIG. 29 is a side elevational cross-sectional view of the FIG. 27 adjustable assembly.
Figure 30:
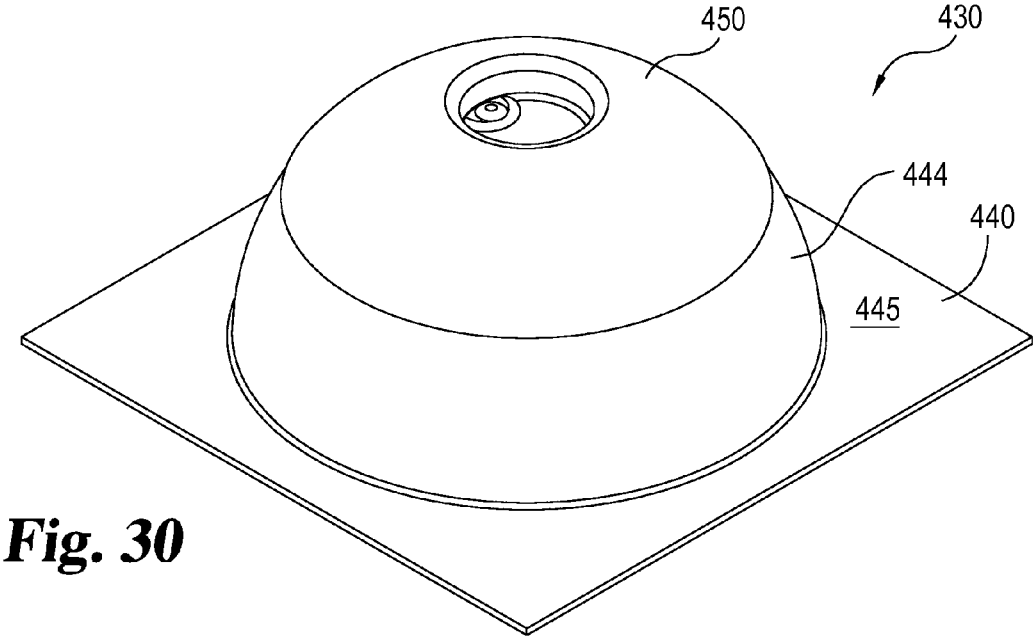
FIG. 30 is a top perspective view of a fourth embodiment of an adjustable assembly.
Figure 31:
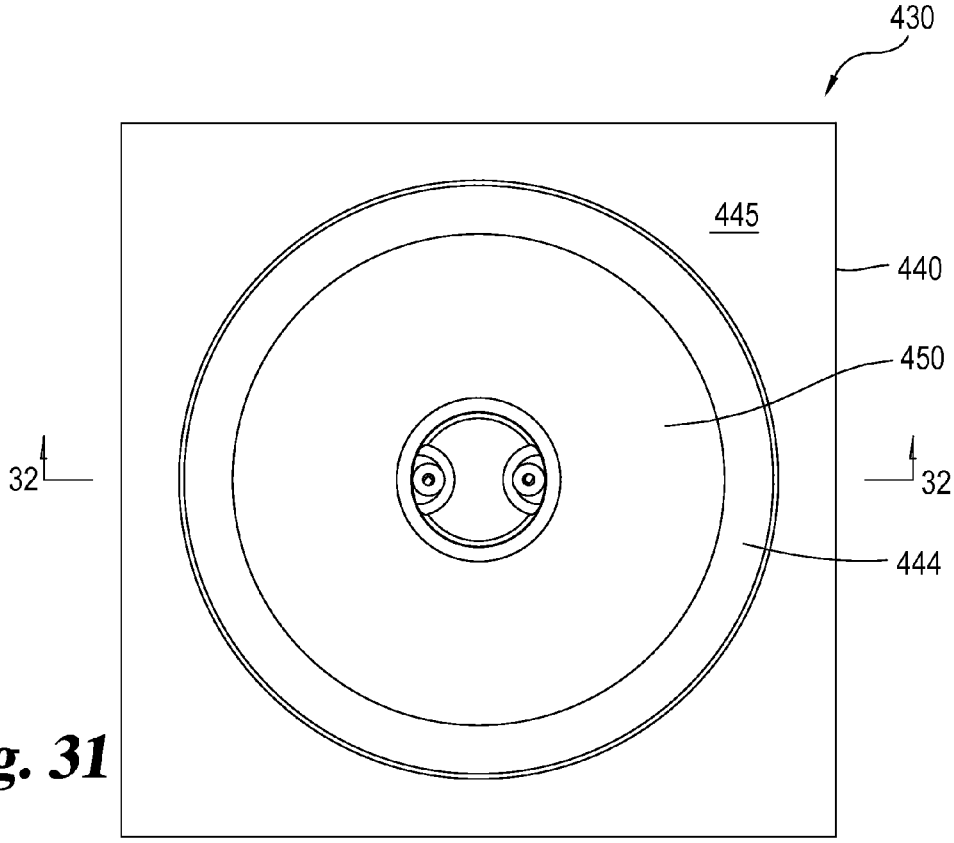
FIG. 31 is a top plan view of the FIG. 30 adjustable assembly.
Figure 32:
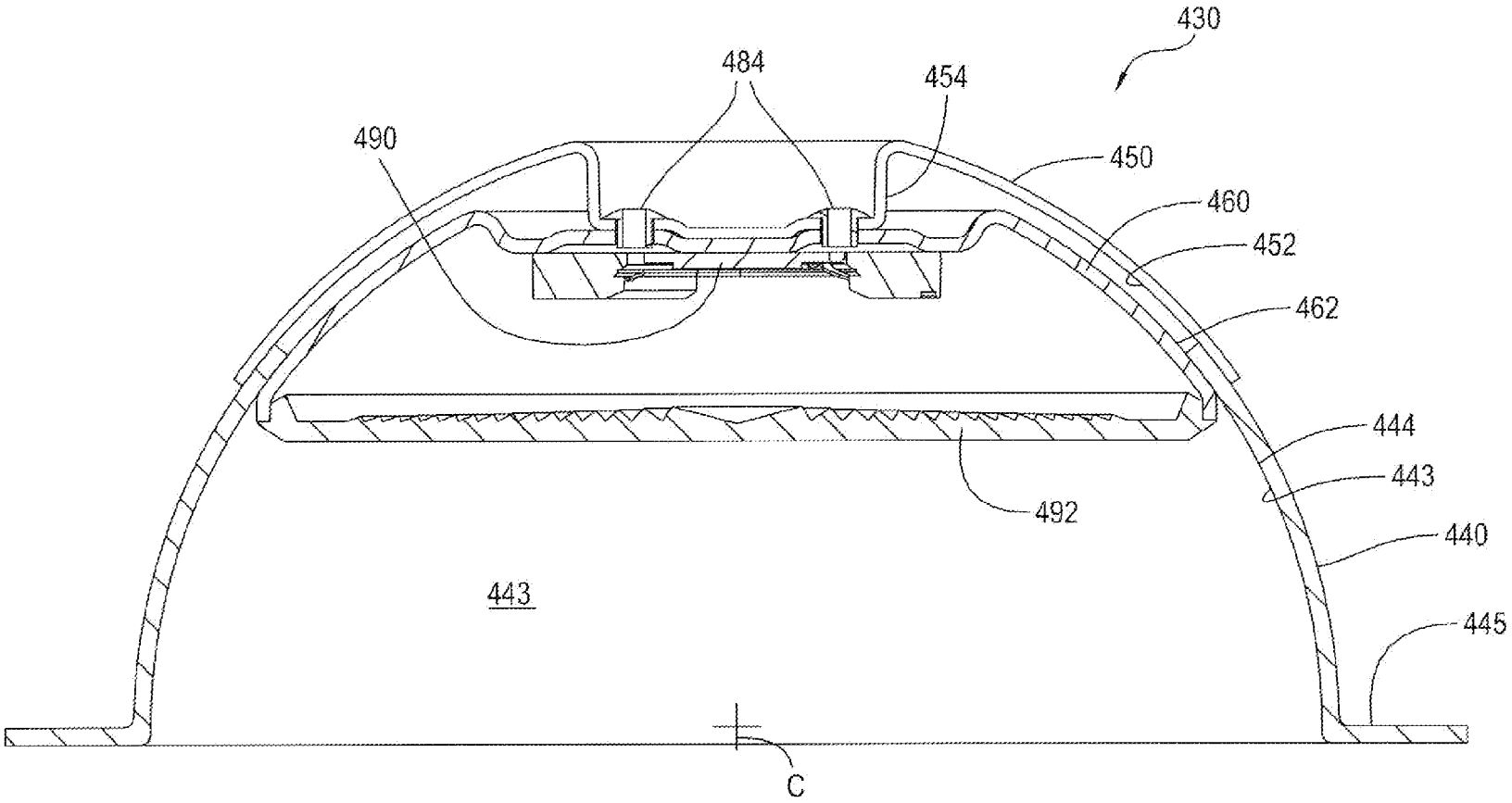
FIG. 32 is a side elevational cross-sectional view of the FIG. 30 adjustable assembly taken along line 32-32 of FIG. 31.
Figure 33:
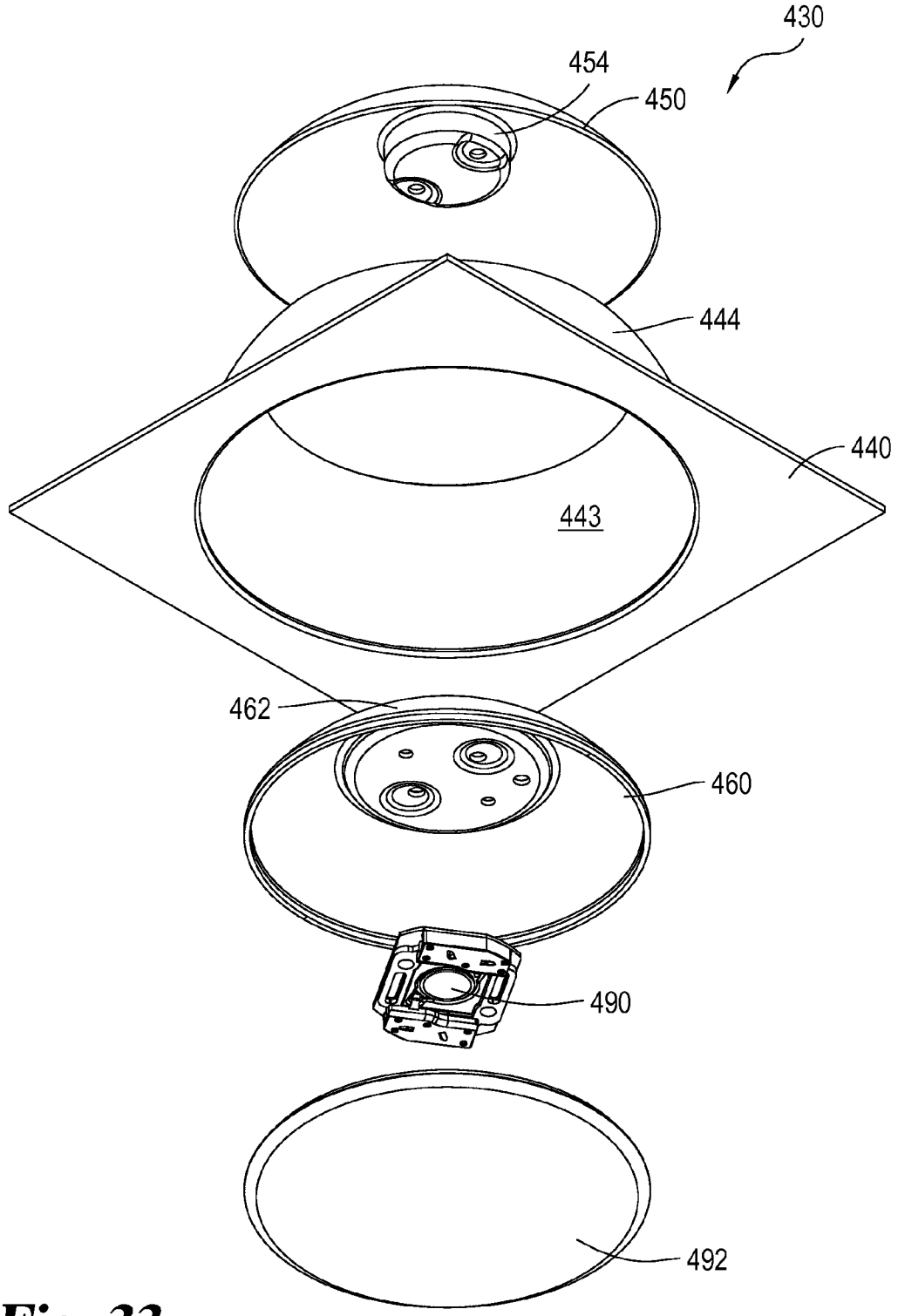
FIG. 33 is a bottom perspective exploded assembly view of the FIG. 30 adjustable assembly.
Figure 34:
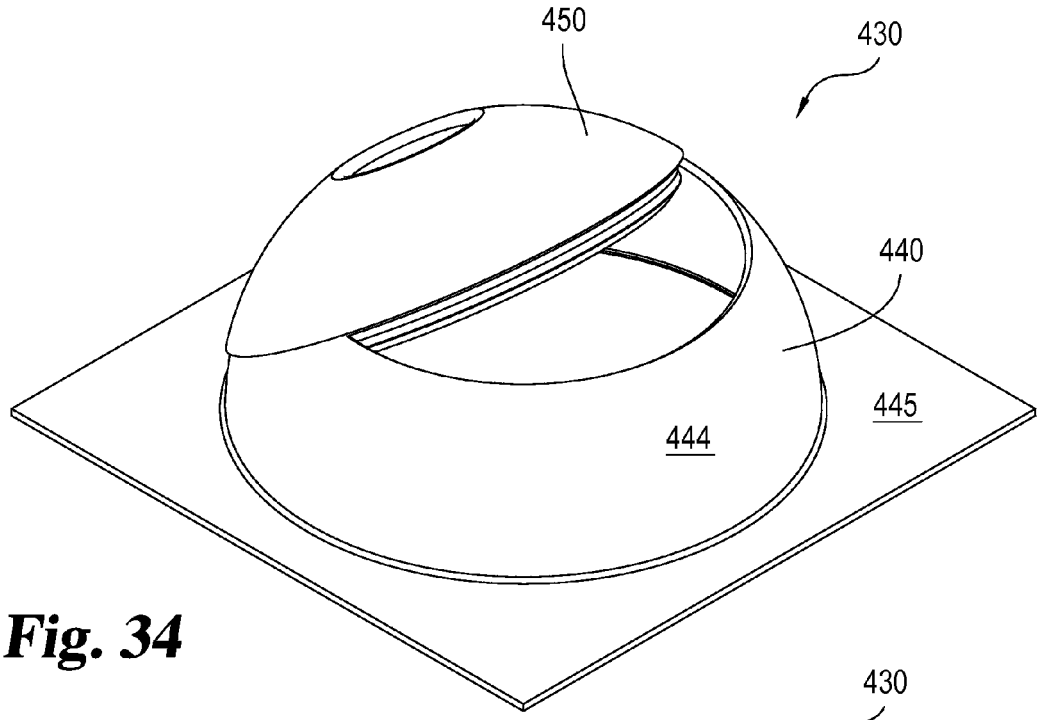
FIG. 34 is a top perspective view of the FIG. 30 adjustable assembly with the outer member skewed at an angle relative to the main body.
Figure 35:
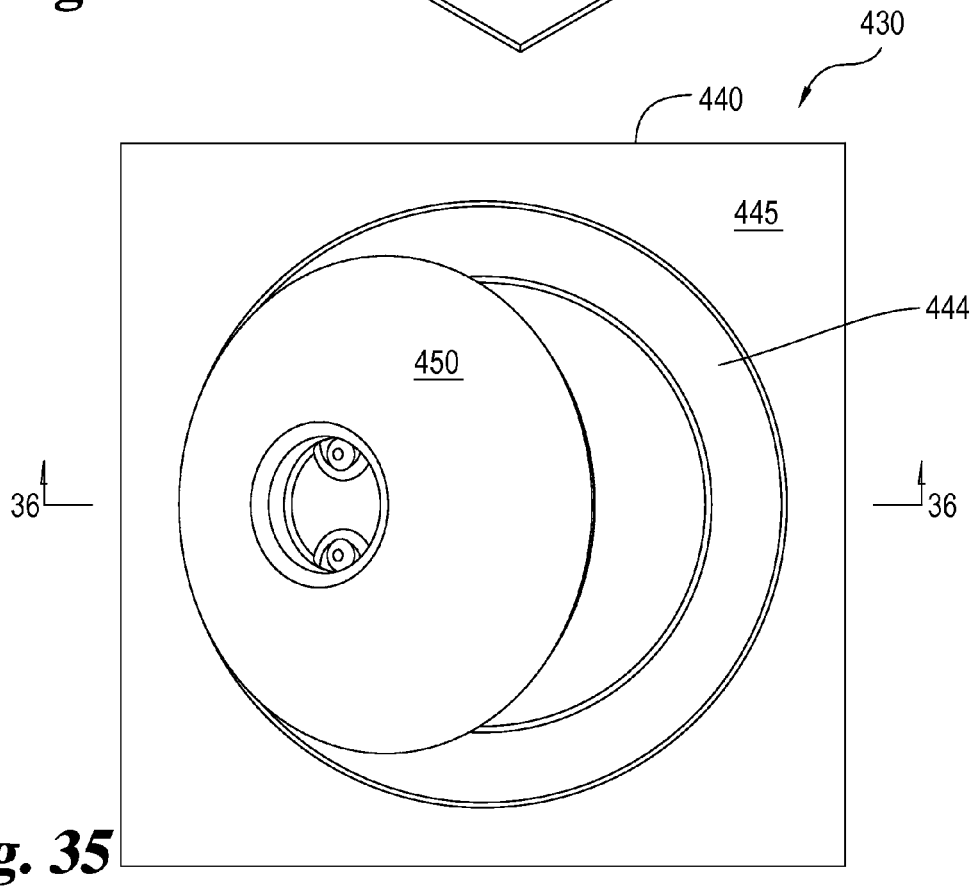
FIG. 35 is a top elevational view of the FIG. 34 configuration.

In FIG. 29, tilt angle AT is approximately maximum with light source 390 and lens 392 having a direction of emission V3 that is approximately centered on center point C.

Referring now to FIGS. 30-36, a fourth embodiment of an adjustable assembly is shown in isolated detail as adjustable assembly 430. Adjustable assembly 430 generally includes main body 440, outer member 450, inner member 460, light 490 and lens 492. Adjustable assembly 430 is interchangeable with adjustable assembly 130 for use in light fixture 100. Main body 440 includes inner surface 443, outer surface 444 and flange 445.

Outer member 450 defines a curved inner surface 452 with center portion 454 downwardly from the center of curved inner surface 452. Curved inner surface 452 may approximate a segment of a hollow sphere.

Adjustable assembly 430 is assembled with outer member 450 and inner member 460 coupled together by rivets 484 with main body 440 entrapped between outer member 450 and inner member 460. Light source 490 is mounted directly to inner member 460 with lens 492 also mounted to inner member 460.

Center portion 454 passes through main body 440. Main body 440 is sandwiched between outer member 450 and inner member 460 with main body 440 abutting other outer member 450 and inner member 460 with sufficient force to generate sufficient friction between the contacting members to substantially prevent movement of inner member 460 relative to main body 440 absent an external force. However, these components may be configured such that the force is not sufficient to prevent a human user from manually overcoming the friction between the components to manually reposition inner member 460 and light source 490 relative to main body 440.

Figure 36:
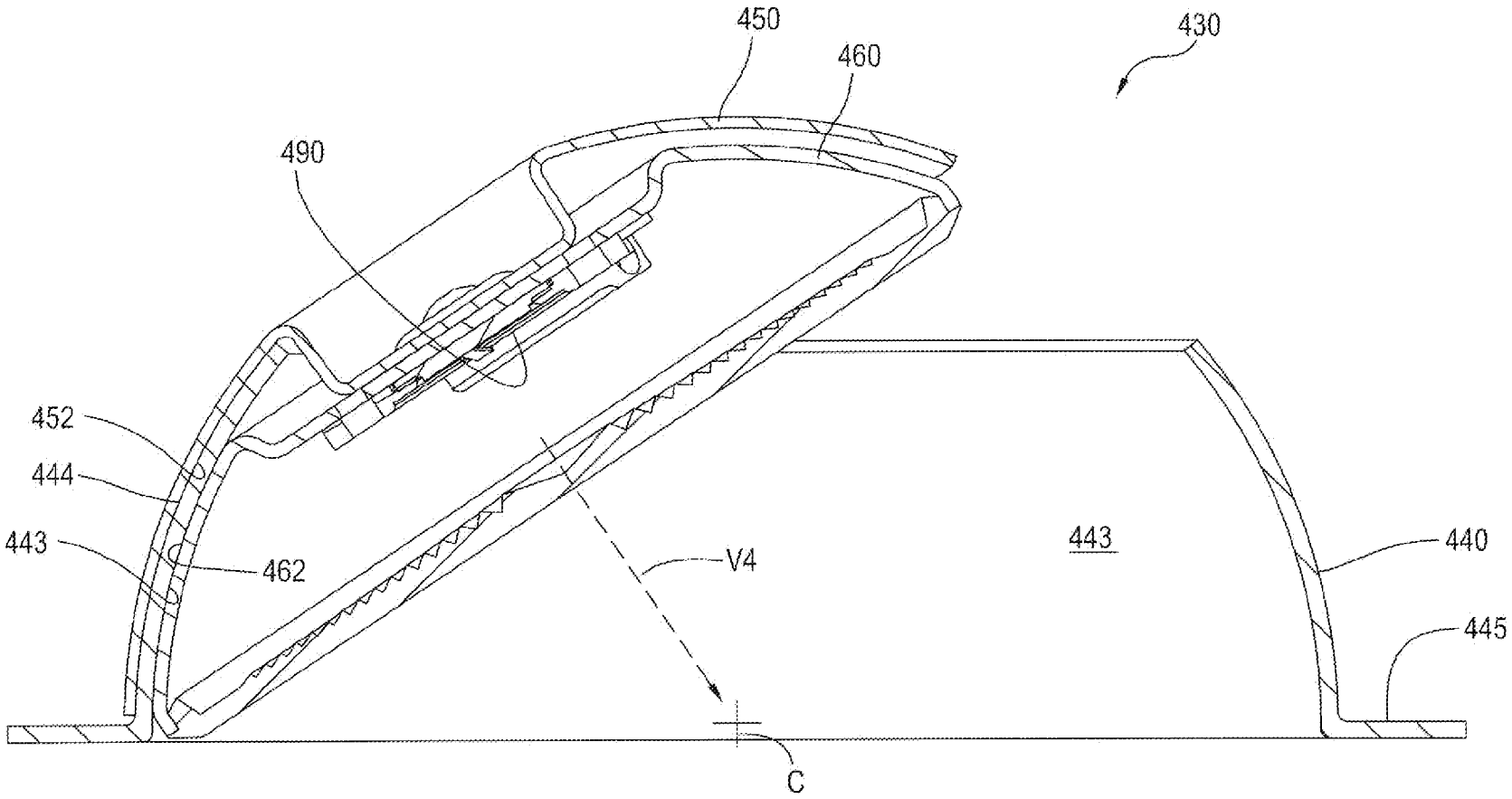
FIG. 36 is a side elevational cross-sectional view of the FIG. 34 configuration taken along line 36-36 in FIG. 35.
Figure 37:
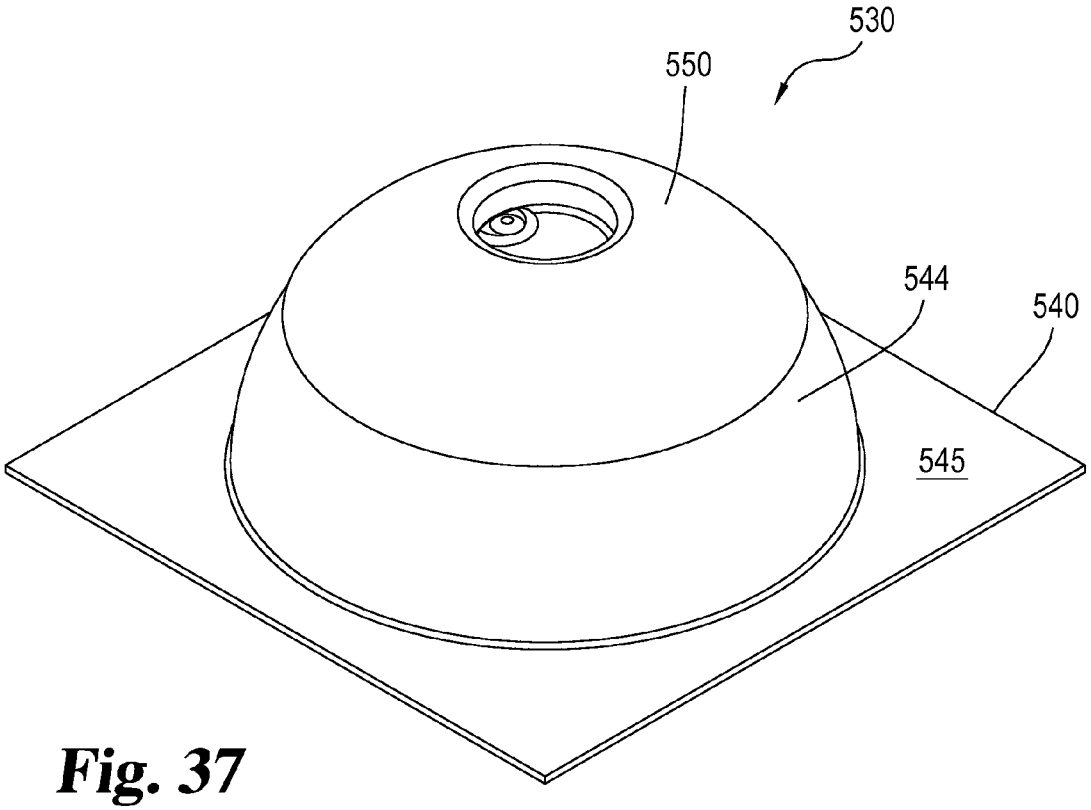
FIG. 37 is a top perspective view of a fifth embodiment of an adjustable assembly.
Figure 38:
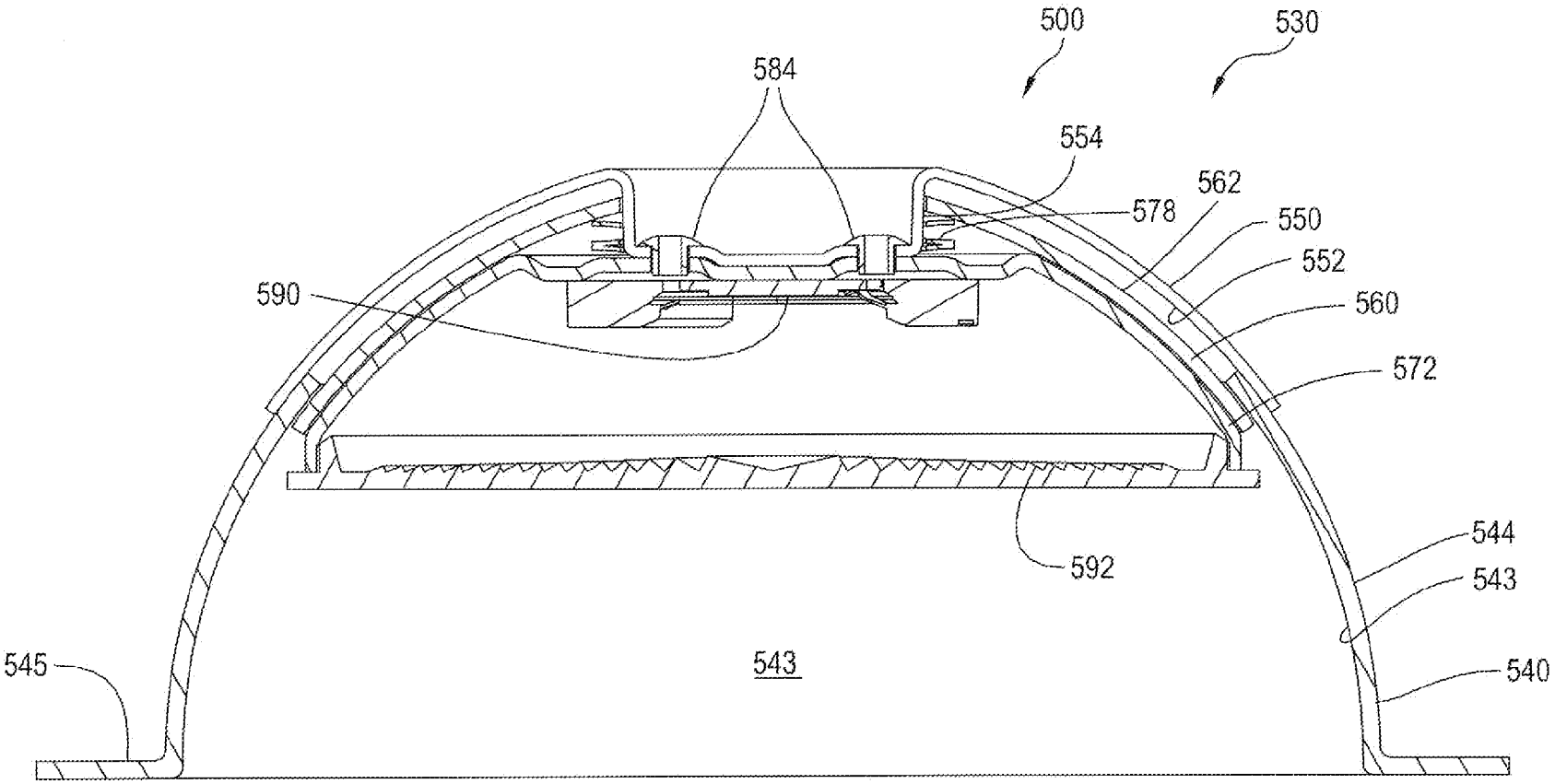
FIG. 38 is a side elevational cross-sectional view of the FIG. 37 adjustable assembly.
Figure 39:
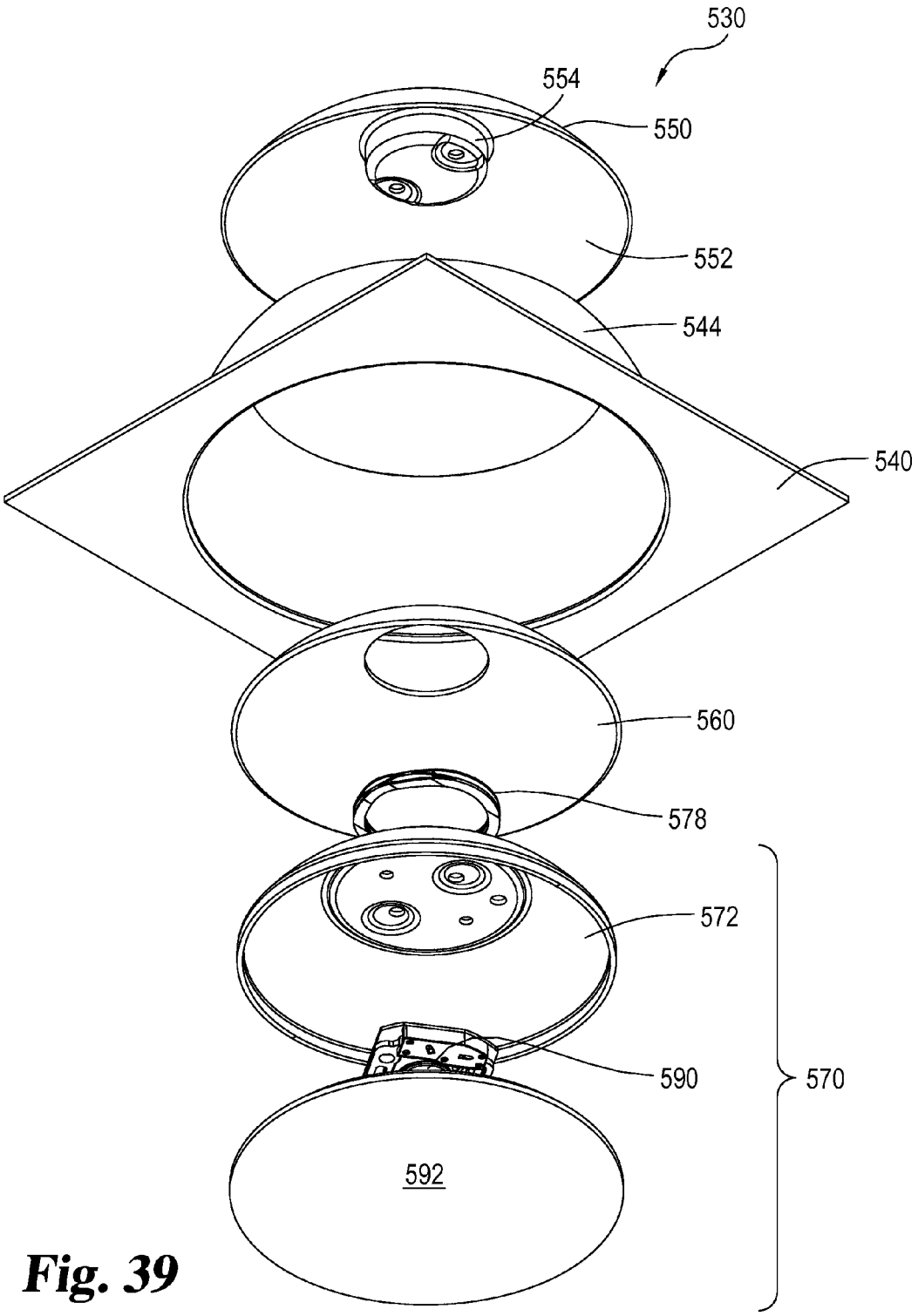
FIG. 39 is a bottom perspective exploded assembly view of the FIG. 37 adjustable assembly.

In FIG. 36, tilt angle AT is approximately maximum with light source 490 and lens 492 having a direction of emission V4 that is approximately centered on center point C.

Referring now to FIGS. 37-40, a fifth embodiment of an adjustable assembly is shown in isolated detail as adjustable assembly 530. Adjustable assembly 530 generally includes main body 540, outer member 550, inner member 560, spring 578 and light assembly 570. Adjustable assembly 530 is interchangeable with adjustable assembly 130 for use in light fixture 100.

Light assembly 570 includes light housing 572, light source 590 and lens 592.

Main body 540 defines top opening 546 and includes inner surface 543, outer surface 544 and flange 545. Outer member 550 defines a curved inner surface 552 with center portion 554 extending downwardly from the center of curved inner surface 552. Curved inner surface 552 may approximate a segment of a hollow sphere.

Adjustable assembly 530 is assembled with outer member 550 and light housing 572 coupled together by rivets 584 with main body 540 and inner member 560 entrapped between outer member 550 and light housing 572. Light source 590 is mounted directly to light housing 572 with lens 592 also mounted to light housing 572.

Center portion 554 passes through main body 540 and inner body 560. Main body 540 and inner body 560 are sandwiched between outer member 550 and light housing 572 with main body 540 abutting, outer member 550 and inner member 560 with sufficient force to generate sufficient friction between the contacting members to substantially prevent movement of light housing 572 relative to main body 540 absent an external force. However, these components may be configured such that the force is not sufficient to prevent a human user from manually overcoming the friction between the components to manual reposition light housing 572 and light source 590 relative to main body 540.

Figure 40:
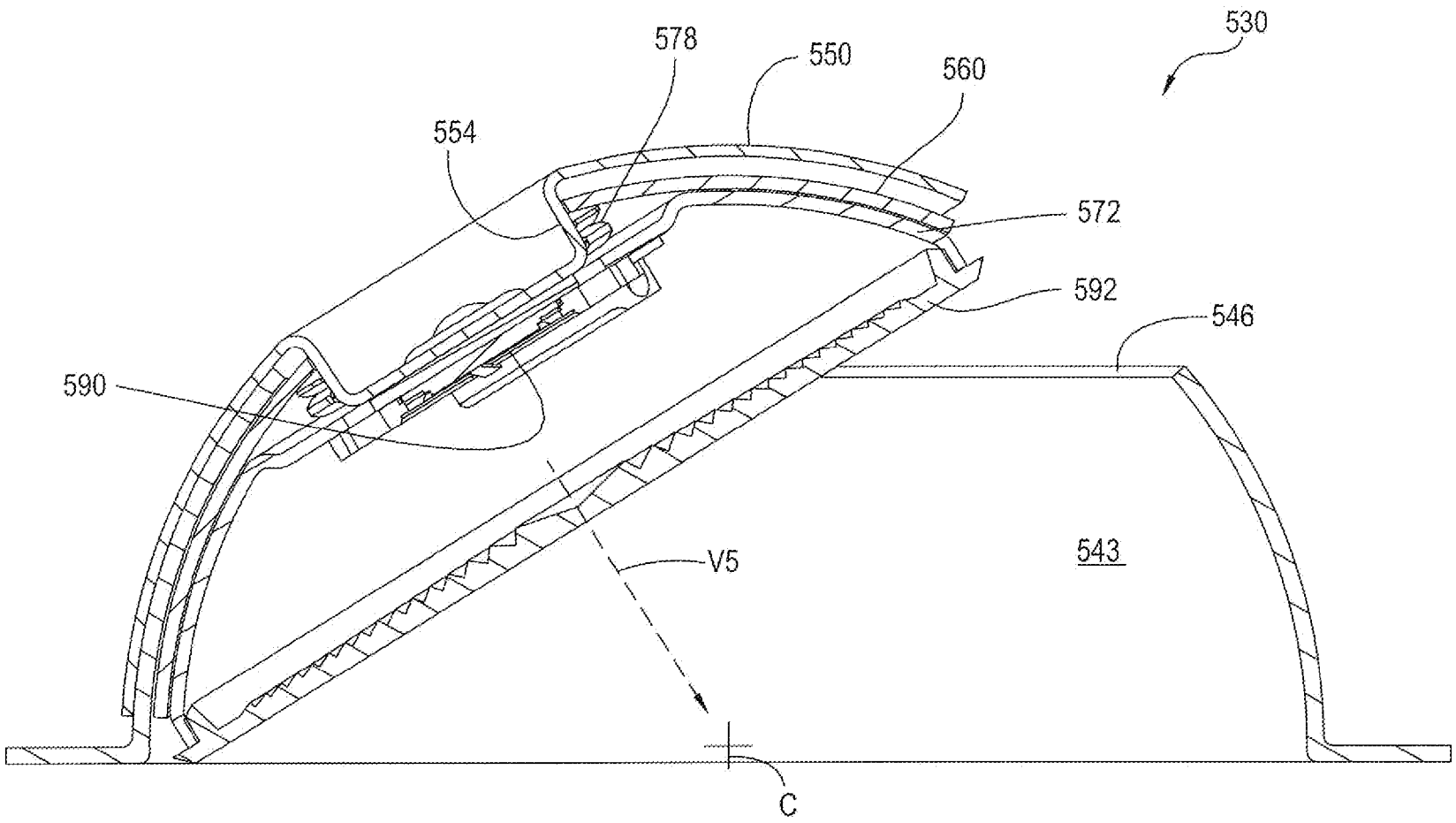
FIG. 40 is a side elevational cross-sectional view of the FIG. 37 adjustable assembly with the outer member skewed at an angle relative to the main body.

In FIG. 40, tilt angle AT is approximately maximum with light source 490 and lens 492 having a direction of emission V5 that is approximately centered on center point C.

Figure 41:
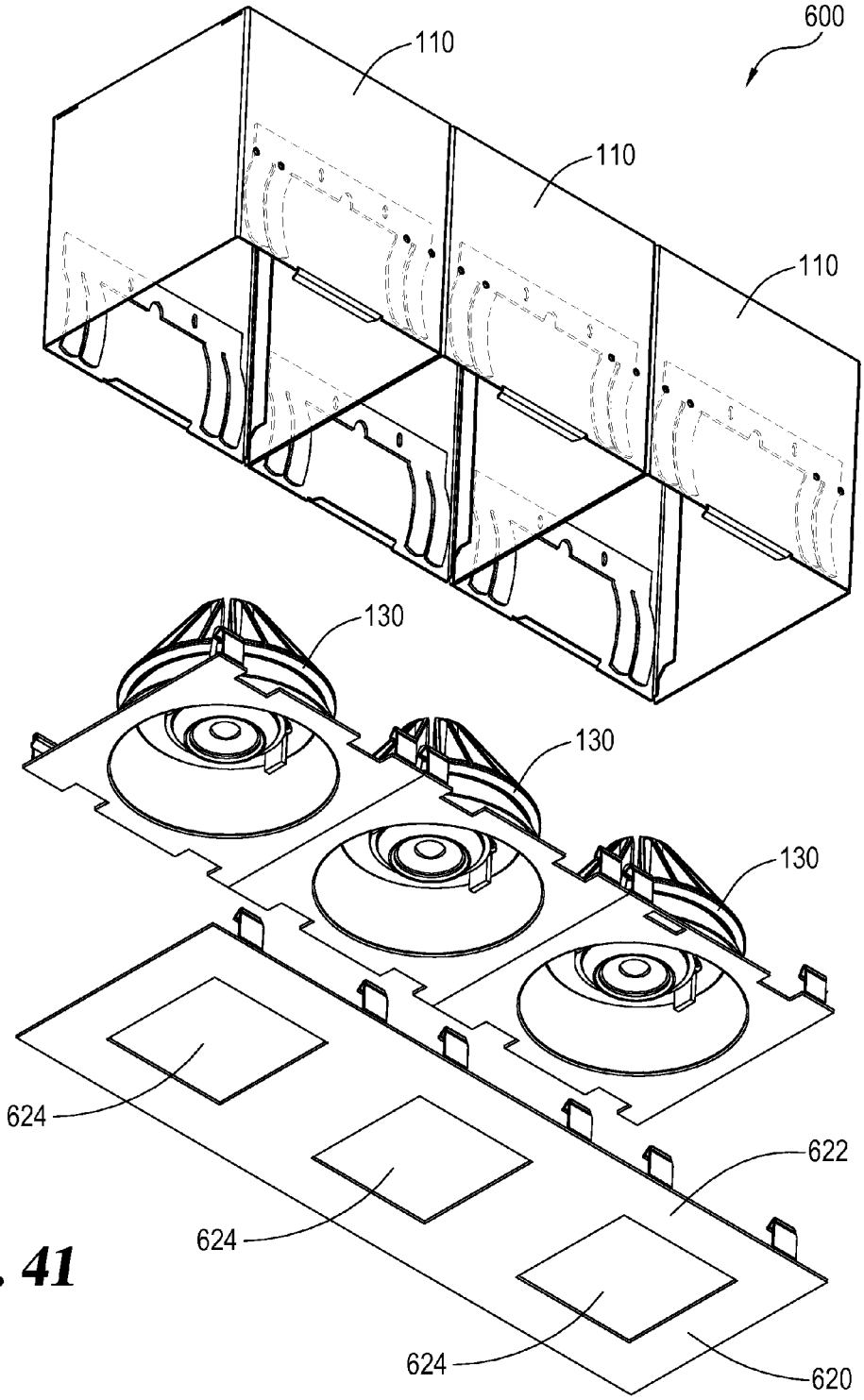
FIG. 41 is a bottom perspective exploded view of a light fixture assembly incorporating three of the FIG. 4 adjustable assemblies.

Referring to FIG. 41, light fixture assembly 600 is illustrated. Light fixture assembly 600 incorporated a plurality of enclosures 110 and adjustable assemblies 130 together with a trim 620 that covers each of the enclosures 110 and adjustable assemblies 130. In the illustrated embodiment, three sets of enclosures 110 and adjustable assemblies 130 are illustrated. However it should be understood that any number of enclosures 110 and adjustable assemblies 130 can be used together in any desired configuration. As illustrated, each enclosure 110 and adjustable assembly 130 may be positioned in close proximity to adjacent enclosures 110 and adjustable assemblies 130. In the illustrated embodiment, the adjacent adjustable assemblies 130 and enclosures 110 abut. Note, while not illustrated, a unitary housing may be used in lieu of multiple enclosures 110. Such a unitary housing would include space for multiple adjustable assemblies 130.

Trim 620 includes a single plate 622 that defines multiple openings 624, with each opening 624 positioned below an individual enclosure 110 and adjustable assembly 130. Utilizing a single plate 622 may create a more visually pleasing appearance as plate 622 does not include additional breaks that would be required if multiple plates were utilized.

Referring to FIGS. 42-45, a sixth embodiment of an adjustable assembly is shown in isolated detail as adjustable assembly 730. Adjustable assembly 730 generally includes main body 140, outer member 750, inner member 160, intermediate member 186, locking collar 772 and light source 790. Main body 140, inner member 160 and intermediate member 186 are substantially the same as the components described above with regard to adjustable assembly 130. Adjustable assembly 730 is interchangeable with adjustable assembly 130 for use in light fixture 100. The description of other elements of light fixture 100 are not repeated for brevity.

Figure 42:
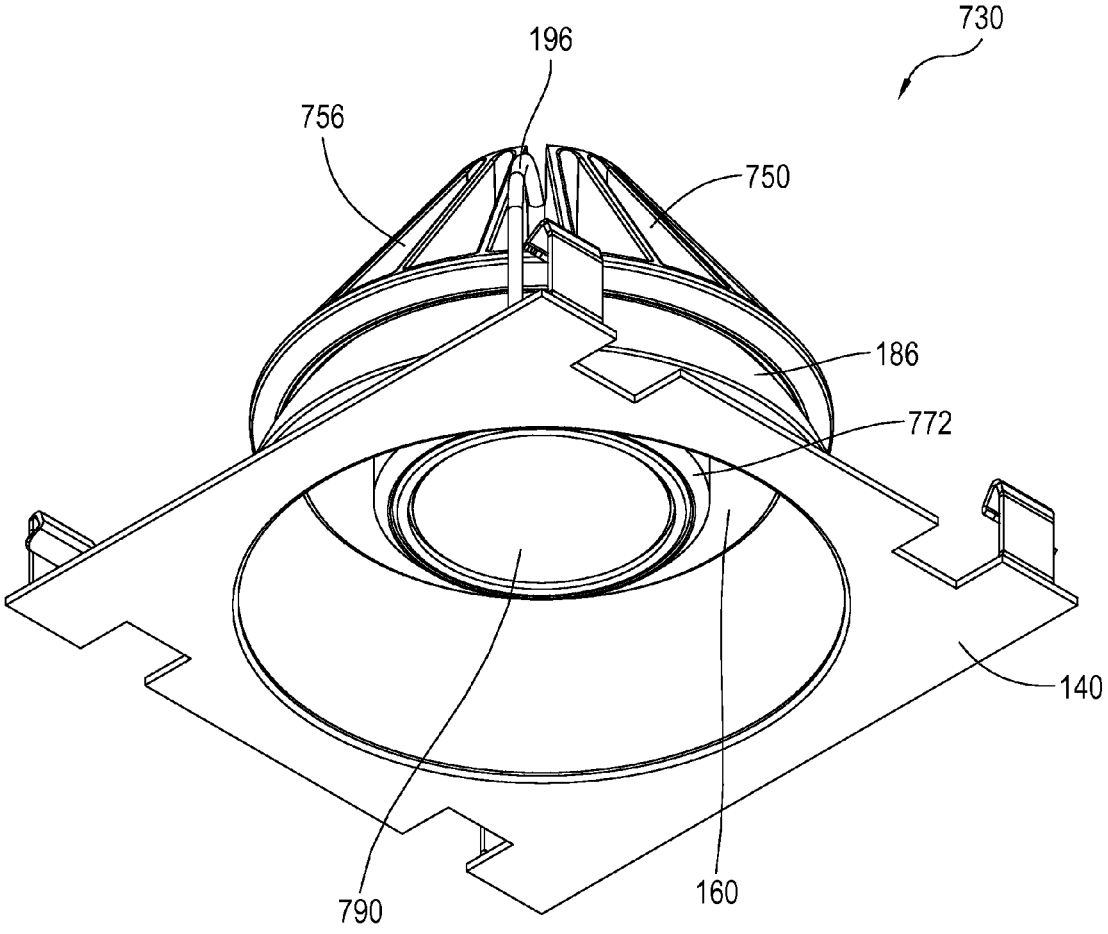
FIG. 42 is a bottom perspective view of a sixth embodiment of an adjustable assembly.
Figure 43:
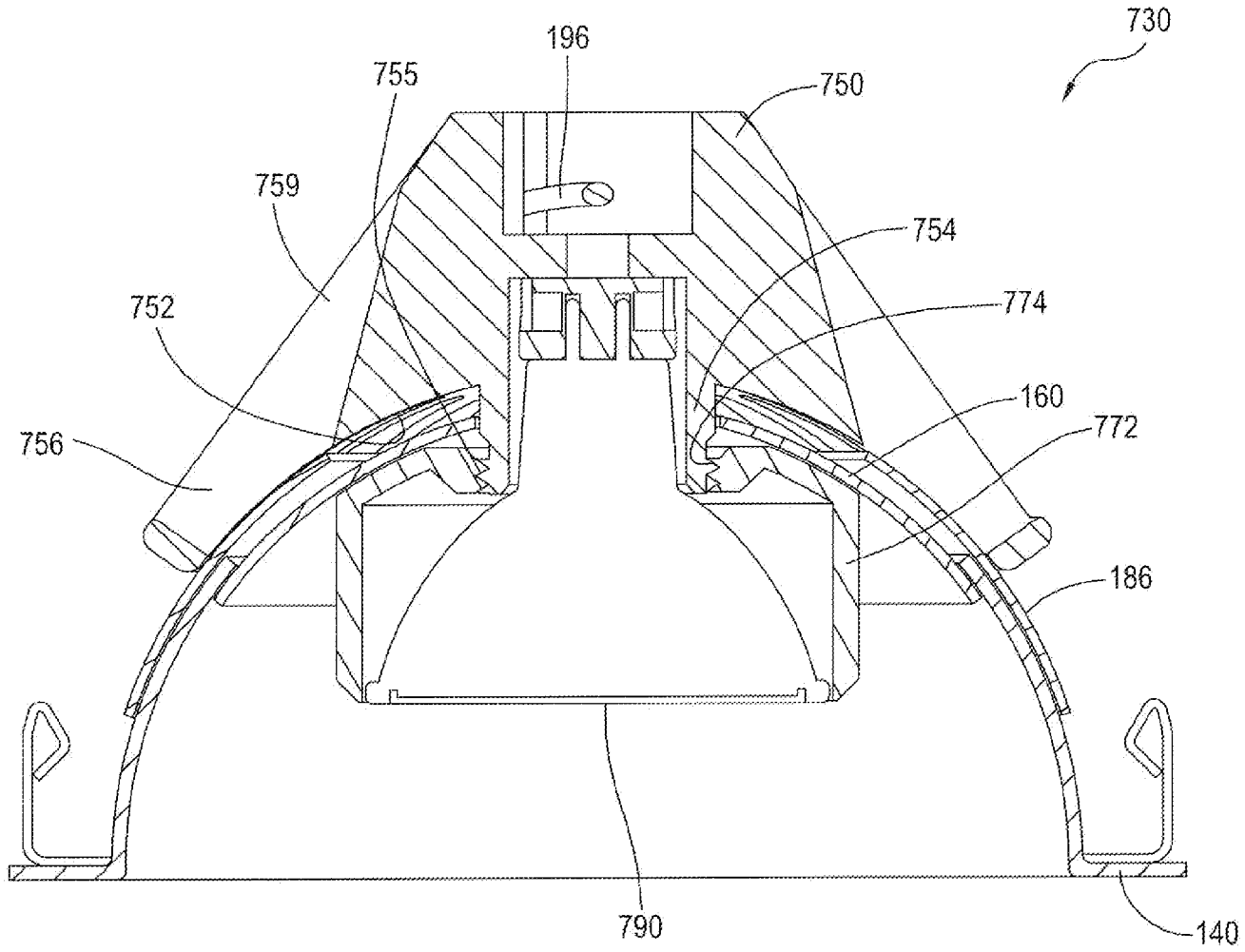
FIG. 43 is a side elevational cross-sectional view of the FIG. 42 adjustable assembly.

As best seen in FIGS. 42 and 43, outer member 750 defines a curved surface 752 with center portion 754 extending downwardly from the center of curved surface 752. Center portion 754 includes external threads 755. Outer member 750 includes a plurality of fins 756 on its top with fins 756 extending upwardly and outwardly from curved surface 752. Note that curved surface 752 is defined by fins 756 and fins 756 are spaced apart from each other, such that curved surface 752 is not contiguous, but instead encompasses a plurality of fin segments that together define curved surface 752. Fins 756 define a conical profile 759 on the outer surface of outer member 750. Curved surface 752 may approximate a segment of a hollow sphere.

Locking collar 772 is a generally cylindrical body that defines internally threaded opening 774. Locking collar 772 is threadingly engaged with center portion 754 of outer member 750 and is movable relative to outer member 750 through threaded rotation of locking collar 772 relative to outer member 750. Rotating locking collar 772 in a tightening direction moves locking collar 772 upward relative to outer member 750. Sufficiently tightening locking collar 772 against inner member 160 may result in sufficient friction between locking collar 772, inner member 160, main body 140, outer member 750 and intermediate member 186 to substantially prevent relevant movement absent an external force. In addition, loosening locking collar 772 may permit relative movement between outer member 750, inner member 160, main body 140 and intermediate member 186 to allow the orientation of light source 790 to be repositioned relative to main body 140.

Adjustable assembly 730 is assembled with intermediate member 186, main body 140 and inner member 160 entrapped between outer member 750 and locking collar 772. Center portion 754 passes through intermediate member 186, main body 140 and inner member 160. Light source 290 is mounted to outer member 750 and passes through center portion 754.

In the illustrated embodiment, light source 790 is an incandescent lamp with an integrated lens. Various types of lamps can be used as light source 790, such as filament wires, halogen lamps, fluorescent lamps and gas discharge lamps.

Figure 44:
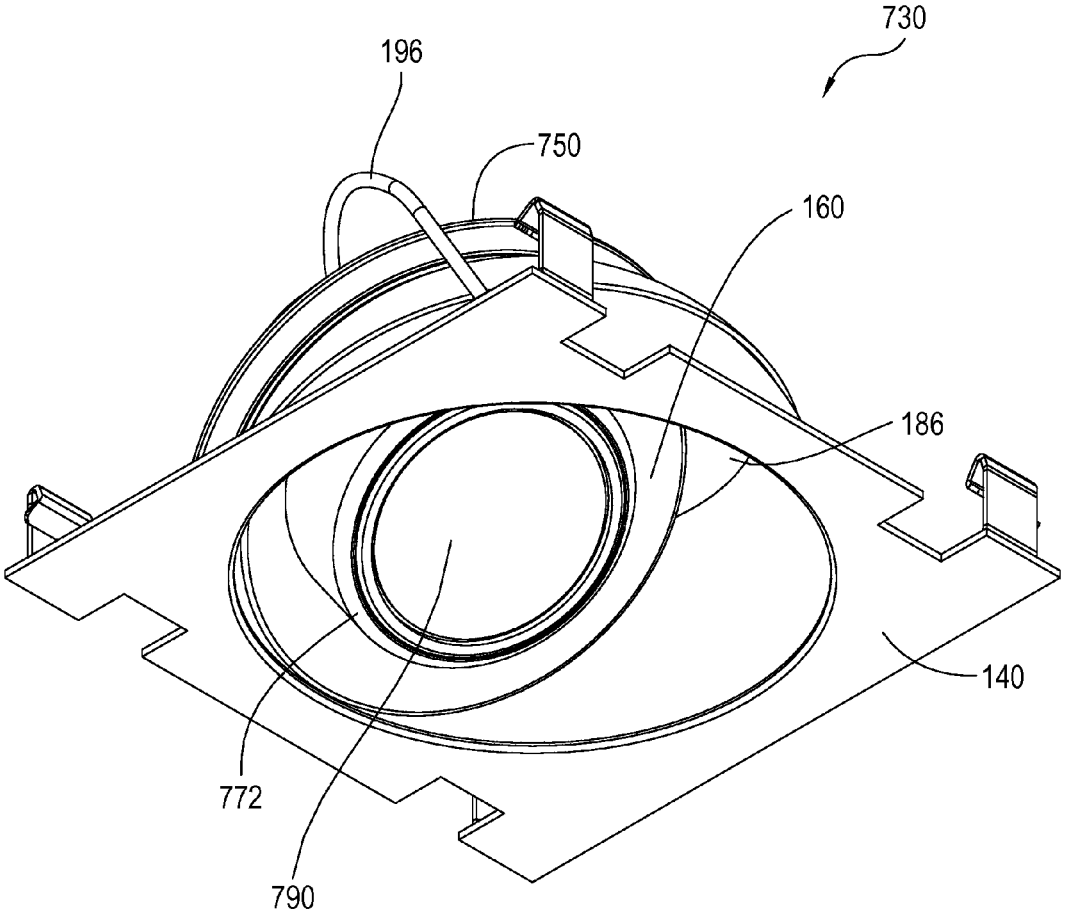
FIG. 44 is a bottom perspective view of the FIG. 42 adjustable assembly with the outer member skewed at an angle relative to the main body.
Figure 45:
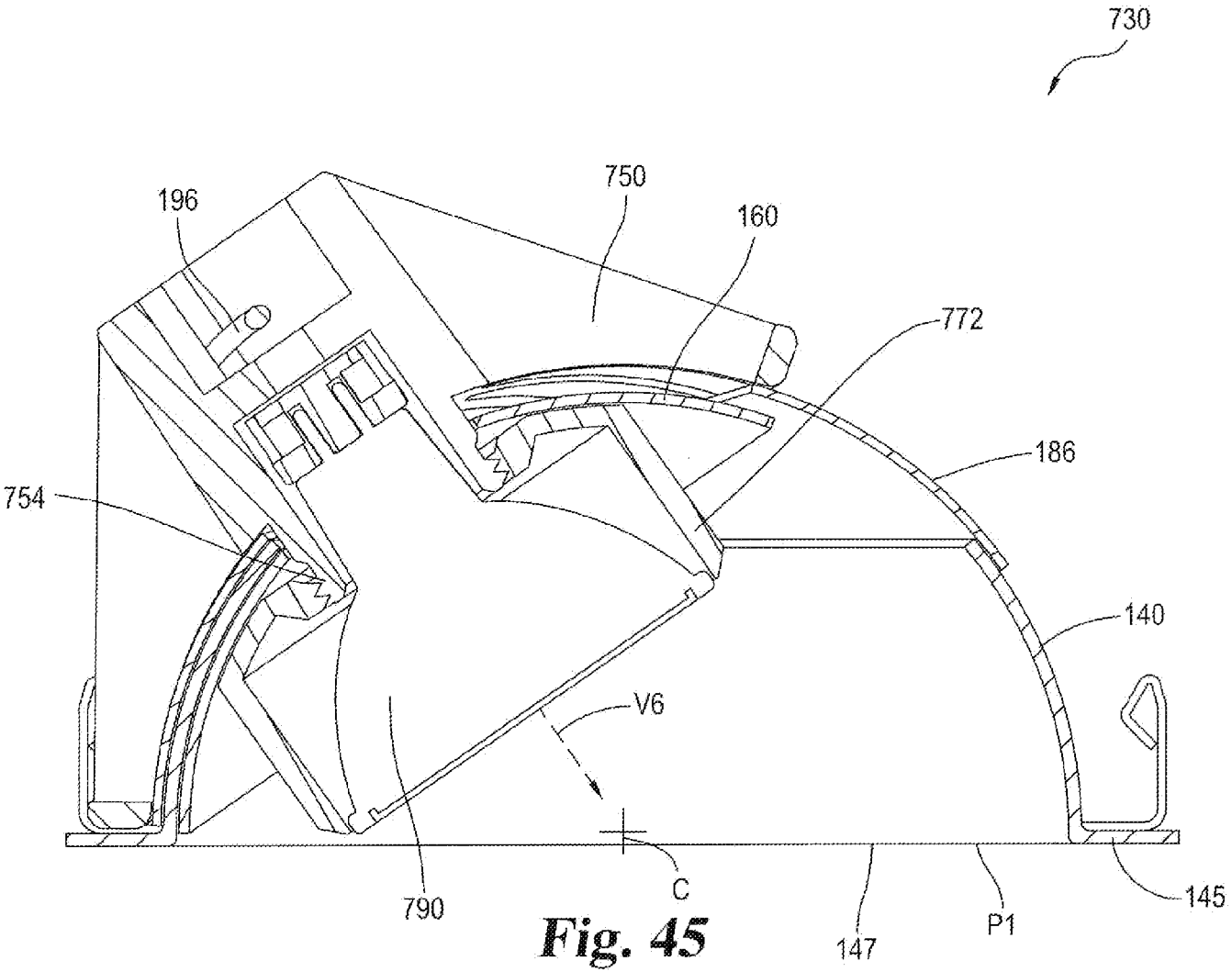
FIG. 45 is a side elevational cross-sectional view of the FIG. 44 adjustable assembly with the outer member skewed at an angle relative to the main body.

As shown in FIGS. 44-45, the illustrated outer member 750 is selectively movable relative to main body 140 to alter the position of light source 790 relative to main body 140 and to alter the angular orientation of light source 790 relative to bottom plane P1. Relative movement of outer member 750 moves the position and angular orientation of light source 790 relative to main body 140.

Light source 790 has a direction of light emission V6 that may pass through center point C regardless of the relative position of light source 790 relative to main body 140. In addition, no portion of light source 790 or locking collar 772, extends through bottom plane P1. Accordingly, light source 790 can be positioned anywhere allowed by the geometry of the various components of adjustable assembly 730 without interfering with or blocking use of trim that may cover a portion of bottom opening 147 of main body 140. While center point C is positioned above any attached trim by approximately the thickness of flange 145 and the trim, this configuration may still result in emitted light being directed through an approximate middle of an opening in the trim and may minimize emitted light being blocked by trim, regardless of the relative position of light source 790 to main body 140.

Disclosed above are several structures that permit selective relative movement and angular reorientation of the light source relative to the light fixture, including structures that selectively urge abutting elements together and apart to allow relative movement as well as to secure abutting components from easily moving against each other. It should be understood that the disclosed structures are not limiting in that other structures may be utilized to achieve relative movement of different components. For example, an angled surface could be actuated as a wedge against a biasing force to selectively move elements apart and bring them back together.

While the invention has been illustrated and described in detail in the drawings and foregoing description, the same is to be considered as illustrative and not restrictive in character. All changes and modifications that come within the spirit of the invention are desired to be protected.

I claim:

1. A light fixture comprising:

a hollow main body element that defines a shape that approximates a spherical segment with a central top opening and a bottom opening, wherein the bottom opening defines a bottom plane;

a lamp assembly comprising:

a light source;

an inner element;

an outer element, wherein the light source, the inner element and the outer element are operatively coupled together with the outer element positioned above the hollow main body element and the inner element positioned above the bottom plane with the hollow main body element positioned between the outer element and the inner element;

a central portion, carrying the light source, wherein the central portion extends through the central top opening of the hollow main body element and operatively couples the inner element to the outer element; and a biasing element positioned below the inner element, wherein the biasing element forms an abutting relationship between the outer element, the hollow main body element, and the inner element, wherein the abutting relationship results in a frictional force that prevents movement between the outer element, the hollow main body element, and the inner element;

wherein the lamp assembly is constructed and arranged to be selectively movable according to a selective rotation of the outer element relative to the hollow main body element, wherein the selective rotation of the outer element is based on application of an external force on one or more elements of the lamp assembly that overcomes the frictional force caused by the abutting relationship, wherein moving the lamp assembly relative to the hollow main body element alters both a relative position of the lamp assembly relative to the hollow main body element and an angular orientation of the light source relative to the bottom opening and wherein the lamp assembly is constructed and arranged such that, regardless of the position of the lamp assembly relative to the hollow main body element, no portion of the lamp assembly extends below the bottom plane of the hollow main body element.

2. The light fixture of claim 1, further comprising a peripheral flange that extends away from the bottom opening of the hollow main body element.

3. The light fixture of claim 2, further comprising a light fixture housing that is constructed and arranged to be recess mounted in a wall or ceiling structure, wherein the light fixture housing is constructed and arranged to receive the hollow main body element with the peripheral flange positioned substantially flush with a surface of the wall or ceiling structure in which the light fixture housing is mounted.

4. The light fixture of claim 3, further comprising a trim constructed and arranged to cover the housing and at least a portion of the peripheral flange.

5. The light fixture of claim 4, wherein the light source has a direction of primary light emission, wherein the lamp assembly and the hollow main body element are constructed and arranged such that the direction of primary light emission passes through an approximate middle of the bottom of the hollow main body element regardless of the position of the light relative to the hollow main body element.

6. The light fixture of claim 2, wherein the peripheral flange lies approximately along a great circle of the hollow spherical segment that defines the shape of the hollow main body element.

7. A light fixture comprising:

a hollow main body element that defines a shape that approximates a spherical segment with a central top opening and a bottom opening;

a lamp assembly comprising:

a light source;

an inner element;

an outer element, wherein the light source, the inner element and the outer element are operatively coupled together with the outer element positioned above the hollow main body element and the inner element positioned below the hollow main body element with the hollow main body element positioned between the outer element and the inner element;

a central portion, carrying the light source, wherein the central portion extends through the central top opening of the hollow main body element and operatively couples the inner element to the outer element; and an actuation mechanism constructed and arranged to selectively move the position of the inner element relative to the outer element, wherein moving the inner element towards the outer element increases a frictional force that prevents movement between the outer element, the hollow main body element, and the inner element;

wherein the lamp assembly is constructed and arranged to be selectively movable according to relief of the frictional force caused by the actuation mechanism and selective rotation of the outer element relative to the hollow main body element, wherein the selective rotation of the outer element is based on application of an external force on one or more elements of the lamp assembly, wherein moving the lamp assembly relative to the hollow main body element alters an orientation of the light source relative to the bottom opening and wherein a position of the lamp assembly relative to the hollow main body element may be selectively secured by operation of the actuation mechanism.

8. The light fixture of claim 1, wherein the biasing element comprises a locking collar that is threadingly engaged with the central portion such that the locking collar can be selectively moved relative to the hollow main body element by rotating it relative to the lamp assembly, wherein selective rotation of the locking collar reduces the frictional force that prevents movement between the outer element, the hollow main body element, and the inner element.

9. The light fixture of claim 7, wherein the inner element, the outer element and the hollow main body element each have radial arc angles that are substantially equal.

10. The light fixture of claim 7, wherein the outer element defines a concave shape that approximates a segment of a sphere.

11. The light fixture of claim 10, further comprising an intermediate element that defines a shape that approximates a hollow spherical segment, wherein the intermediate element is positioned between the inner and outer elements of the lamp assembly and wherein the intermediate element is constructed and arranged to cover any void between the hollow main body element and the outer element for any position of the lamp assembly relative to the hollow main body element.

12. The light fixture of claim 11, wherein the outer element, the intermediate element and the hollow main body element all have radial arc angles that are substantially equal.

13. The light fixture of claim 12, wherein the inner element defines a shape that approximates a portion of a sphere and wherein the inner element has a radial arc angle that is substantially equal to the radial arc angle of the hollow main body element.

14. A light fixture comprising:

a hollow main body element that defines a shape that approximates a spherical segment with a central top opening and a bottom opening;

a lamp assembly comprising:

a light source;

an inner element;

an outer element, wherein the light source, the inner element and the outer element are operatively coupled together with the outer element positioned above the hollow main body element and the inner element positioned below the hollow main body element with the hollow main body element positioned between the outer element and the inner element;

a central portion, carrying the light source, wherein the central portion extends through the central top opening of the hollow main body element and operatively couples the inner element to the outer element;

an intermediate element that defines a shape that approximates a hollow spherical segment, wherein the intermediate element is positioned between the inner and outer elements of the lamp assembly and wherein the intermediate element freely moves with respect to the lamp assembly; and a locking collar positioned below the inner element, wherein the locking collar is engaged with the central portion such that the locking collar can be selectively moved relative to the inner element to form an abutting relationship between the outer element, the hollow main body element, the intermediate element, and the inner element, wherein the abutting relationship results in a frictional force that prevents movement between the outer element, the hollow main body element, the intermediate element, and the inner element;

wherein the lamp assembly is constructed and arranged to be selectively movable according to relief of the frictional force caused by the locking collar and a selective rotation of the outer element relative to the hollow main body element, wherein the selective rotation of the outer element is based on application of an external force on one or more elements of the lamp assembly, wherein moving the lamp assembly relative to the hollow main body element alters an orientation of the light source relative to the bottom opening.

15. The light fixture of claim 14, wherein the inner element has a radial arc angle substantially equal to a radial arc angle of the hollow main body element.

16. The light fixture of claim 14, wherein the locking collar comprises a releasable clamping mechanism constructed and arranged to selectively urge the inner element, the hollow main body element, the intermediate element and the outer element together.

17. A light fixture comprising:

a hollow main body element that defines a shape that approximates a spherical segment with a central top opening and a bottom opening;

a lamp assembly comprising:

a light source;

an inner element that defines a shape that approximates a portion of a sphere;

an outer element, wherein the light source, the inner element and the outer element are operatively coupled together with the outer element positioned above the hollow main body element and the inner element positioned below the hollow main body element with the hollow main body element positioned between the outer element and the inner element;

a central portion, carrying the light source, wherein the central portion extends through the central top opening of the hollow main body element and operatively couples the inner element to the outer element, wherein the arc angle of the hollow main body element is between approximately 35 degrees and 45 degrees; and a biasing element positioned below the inner element, wherein the biasing element forms an abutting relationship between the outer element, the hollow main body element, and the inner element, wherein the abutting relationship results in a frictional force that prevents movement between the outer element, the hollow main body element, and the inner element;

wherein the lamp assembly is constructed and arranged to be selectively movable according to relief of the frictional force caused by the abutting relationship and a selective rotation of the outer element relative to the hollow main body element, wherein the selective rotation of the outer element is based on application of an external force on one or more elements of the lamp assembly that overcomes the frictional force caused by the abutting relationship, wherein moving the lamp assembly relative to the hollow main body element alters an orientation of the light source relative to the bottom opening.

18. The light fixture of claim 17, wherein the arc angle of the hollow main body element is approximately 40 degrees.

19. The light fixture of claim 17, wherein the hollow main body element has an arc angle between approximately 80 percent and approximately 120 percent of an arc angle of the inner element.

20. The light fixture of claim 7, wherein the actuation mechanism comprises a locking collar that is engaged with the central portion, wherein the locking collar can be selectively moved relative to the hollow main body element through actuation of a plurality of levers coupled to the locking collar, wherein selective actuation of the plurality of levers reduces the frictional force that prevents movement between the outer element, the hollow main body element, and the inner element.

* * * * *